US010782113B2

(12) United States Patent
Brundula et al.

(10) Patent No.: US 10,782,113 B2
(45) Date of Patent: Sep. 22, 2020

(54) SYSTEMS AND METHODS FOR IGNITION IN A CONDUCTED ELECTRICAL WEAPON

(71) Applicant: Axon Enterprise, Inc., Scottsdale, AZ (US)

(72) Inventors: Steven N. D. Brundula, Sedro-Woolley, WA (US); Oleg Nemtyshkin, Scottsdale, AZ (US); Aleksander Petrovic, Phoenix, AZ (US); Patrick W. Smith, Scottsdale, AZ (US)

(73) Assignee: AXON ENTERPRISE, INC., Scottsdale, AZ (US)

( * ) Notice: Subject to any disclaimer, the term of this patent is extended or adjusted under 35 U.S.C. 154(b) by 0 days.

(21) Appl. No.: 16/153,640

(22) Filed: Oct. 5, 2018

(65) Prior Publication Data

US 2020/0109933 A1 Apr. 9, 2020

(51) Int. Cl.

| | |
|---|---|
| ***F42C 19/12*** | (2006.01) |
| ***F41H 13/00*** | (2006.01) |
| ***F41A 19/58*** | (2006.01) |

(52) U.S. Cl.

CPC ..... *F42C 19/12* (2013.01); *F41A 19/58* (2013.01); *F41H 13/0025* (2013.01)

(58) Field of Classification Search

CPC ..... F41A 19/58; F41A 19/60; F41A 19/63; F41A 19/69; F42C 19/12; F41H 13/0025

USPC ..... 102/472, 202.5, 202.7, 202.14, 218, 220

See application file for complete search history.

(56) References Cited

U.S. PATENT DOCUMENTS

| | | | | |
|---|---|---|---|---|
| 3,748,770 | A | 7/1973 | Mitchell | |
| 4,324,060 | A * | 4/1982 | Lawrence | F42B 5/08 102/202.9 |
| 5,285,727 | A * | 2/1994 | Reams, Jr. | F42B 3/188 102/202.5 |
| 5,301,448 | A | 4/1994 | Petrick et al. | |
| 5,608,982 | A | 3/1997 | Bouvard et al. | |
| 6,374,525 | B1 * | 4/2002 | Thomas | F41A 19/58 42/51 |
| 6,805,055 | B1 * | 10/2004 | Jebsen | F41A 19/58 102/205 |
| 6,910,420 | B1 * | 6/2005 | Thompson | C06B 33/00 102/202.5 |

(Continued)

FOREIGN PATENT DOCUMENTS

| | | | | |
|---|---|---|---|---|
| EP | 0510551 | A2 * | 10/1992 | F42B 3/124 |
| KR | 10-2018-0032364 | A | 3/2018 | |

OTHER PUBLICATIONS

KIPO, International Searching Authority, International Search Report and Written Opinion in International Application No. PCT/US2019/054246 dated Jan. 29, 2020.

*Primary Examiner* — Stephen Johnson

(74) *Attorney, Agent, or Firm* — Justin K. Powley

(57) ABSTRACT

A conducted electrical weapon ("CEW") deploys wire-tethered electrodes after generation of an ignition signal. The ignition signal is provided to a deployment unit. The deployment unit includes a primer material adjacent a conductor. The conductor conducts the ignition signal outside the primer material. A temperature of the conductor increases in response to receiving the ignition signal. The primer material ignites in response to the increase in temperature of the conductor.

20 Claims, 6 Drawing Sheets

(56) References Cited

U.S. PATENT DOCUMENTS

| | | | | |
|---|---|---|---|---|
| 2007/0137512 | A1* | 6/2007 | Oda | F42B 3/103<br>102/202.12 |
| 2009/0126592 | A1* | 5/2009 | Mukunoki | B60R 21/26<br>102/202.7 |

* cited by examiner

SYSTEMS AND METHODS FOR IGNITION IN A CONDUCTED ELECTRICAL WEAPON

FIELD OF THE INVENTION

Embodiments of the present invention relate to a conducted electrical weapon ("CEW") (e.g., electronic control system) that deploys electrodes in response to ignition of a primer material.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In some embodiments, a conducted electrical weapon is provided. The conducted electrical weapon comprises a housing and a deployment unit. The housing includes a trigger and a control circuit configured to generate an ignition signal upon actuation of the trigger. The deployment unit includes at least one electrode and a propulsion module. The propulsion module includes a conductor and a primer material. The conductor is coupled to the control circuit and configured to increase in temperature upon receipt of the ignition signal. The primer material is disposed adjacent the conductor within the propulsion module. The primer material is configured to ignite in response to the increase in temperature of the conductor. The conductor conducts the ignition signal outside the primer material. Ignition of the primer material causes the at least one electrode to be deployed from the deployment unit.

In some embodiments, a propulsion device for deploying at least one projectile using an ignition signal from a provided ignition signal source is provided. The device comprises a conductor and primer material. The conductor is coupled to receive the ignition signal from the ignition signal source. The conductor is configured to increase in temperature upon receipt of the ignition signal. The primer material is disposed adjacent the conductor within the propulsion device. The primer material is configured to ignite in response to the increase in temperature of the conductor. The conductor conducts the ignition signal outside the primer material. Ignition of the primer material causes the at least one projectile to be deployed.

In some embodiments, a method of deploying at least one projectile using a propulsion device is provided. The propulsion device includes a conductor adjacent a primer material. The method comprises receiving an ignition signal in the conductor. The ignition signal is conducted by the conductor outside the primer material. The ignition signal is conducted adjacent a surface of the primer material. A temperature of the conductor is increased based on the received ignition signal. A primer material is ignited in response to the increase in temperature of the conductor. Ignition of primer material causes the at least one projectile to be deployed.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
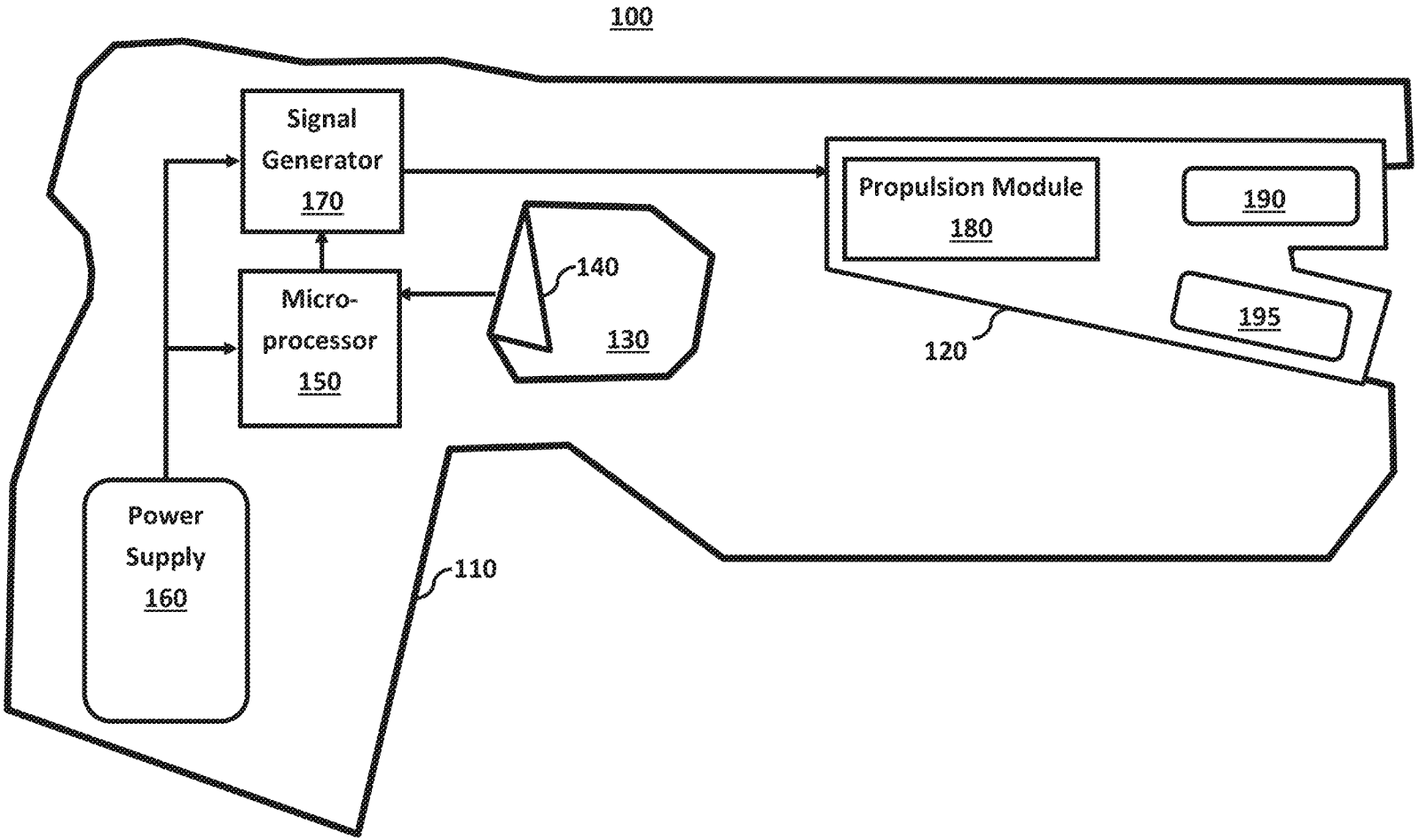
FIG. 1 is a schematic diagram of an example embodiment of a system according to various aspects of the present disclosure.

A projectile may be deployed from a system to interfere with locomotion of a human or animal target. A system may deploy the projectile using an electrical signal. The electrical signal may be used to ignite a primer material. The electrical signal may be the only form of energy provided to the primer material to cause ignition. The electrical signal may be used instead of other forms of energy, such as compression or other physical forces. The use of an electrical signal for ignition provides advantages over other forms of energy. For example, an ignition device employing an electrical signal for ignition does not require moving parts to initiate ignition. An ignition device that employs an electrical signal to initiate ignition may also remain operational in adverse environmental conditions. Adverse environmental conditions may include temperatures that are equal or less than a freezing temperature. Use of an electrical signal for ignition may also employ a battery or other form of power supply that is independently required to perform other functions in a system, thereby increasing a utility of the battery or other form of power supply and potentially decreasing a need for an alternate or additional source of energy.

A conducted electrical weapon ("CEW") is a system that deploys projectiles. The projectiles deployed by a CEW each include an electrode. The projectiles may include one or more wire-tethered electrodes. A stimulus signal may be delivered through a target via one or more wire-tethered electrodes. Delivery via wire-tethered electrodes is referred to as remote delivery (e.g., remote stun). During remote delivery, the CEW is separated from the target up to the length (e.g., 15 feet, 20 feet, 30 feet) of the wire tether. The CEW deploys one or more, usually two or four, electrodes toward the target. As the electrodes fly (e.g., travel) toward the target, their respective wire tethers deploy behind the electrodes. The wire tether electrically couples the CEW to the electrode. The electrode may electrically couple to the target thereby coupling the CEW to the target.

When one or more electrodes land on or are positioned proximate to target tissue, a CEW may provide (e.g., deliver) a current (e.g., stimulus signal, pulses of current, pulses of charge) through tissue of a human or animal target through the one or more electrodes. The stimulus signal carries a charge into target tissue. The stimulus signal may interfere with voluntary locomotion (e.g., walking, running, moving) of the target. The stimulus signal may cause pain. The pain may encourage the target to stop moving. The stimulus signal may cause skeletal muscles of the target to become stiff (e.g., lock up, freeze). The stiffening of the muscles in response to a stimulus signal may be referred to as neuromuscular incapacitation ("NMI"). NMI disrupts voluntary control of the muscles of the target. The inability of the target to control its muscles interferes with locomotion by the target.

A CEW may deploy at least two electrodes to remotely deliver a stimulus signal through a target. The at least two electrodes land on (e.g., impact, hit, strike) or are positioned proximate to target tissue to form a circuit through the first tether and electrode, target tissue, and the second tether and electrode.

Terminals or electrodes that contact or are proximate to target tissue deliver the stimulus signal through the target. Contact of a terminal or electrode with target tissue establishes an electrical coupling (e.g., circuit) with target tissue. Electrodes include a spear that may pierce target tissue to contact target tissue. A terminal or electrode that is proximate to target tissue may use ionization to establish an electrical coupling with target tissue. Ionization may also be referred to as arcing.

In use, a terminal or electrode may be separated from target tissue by the target's clothing or a gap of air. A signal generator of the CEW may provide the stimulus signal (e.g., current, pulses of current) at a high voltage, in the range of 40,000 to 100,000 volts, to ionize the air in the clothing or the air in the gap that separates the terminal or electrode from target tissue. Ionizing the air establishes a low impedance ionization path from the terminal or electrode to target tissue that may be used to deliver the stimulus signal into target tissue via the ionization path. The ionization path persists (e.g., remains in existence, lasts) as long as the current of a pulse of the stimulus signal is provided via the ionization path. When the current ceases or is reduced below a threshold (e.g., amperage, voltage), the ionization path collapses (e.g., ceases to exist) and the terminal or electrode is no longer electrically coupled to target tissue. Lacking the ionization path, the impedance between the terminal or electrode and target tissue is high. A high voltage in the range of about 50,000 volts can ionize air in a gap of up to about one inch.

A CEW may provide a stimulus signal as a series of current pulses. Each current pulse may include a high voltage portion (e.g., 40,000-100,000 volts) and a low voltage portion (e.g., 500-6,000 volts). The higher voltage portion of a pulse of a stimulus signal may ionize air in a gap between an electrode or terminal and a target to electrically couple the electrode or terminal to the target. Once the electrode or terminal is electrically coupled to the target, the lower voltage portion of the pulse delivers an amount of charge into target tissue via the ionization path. For an electrode or terminal that electrically couples to a target by contact (e.g., touching, spear embedded into tissue), the higher portion of the pulse and the lower portion of the pulse both deliver charge to target tissue. Generally, the lower voltage portion of the pulse delivers a majority of the charge of the pulse into target tissue.

The higher voltage portion of a pulse of the stimulus signal is referred to as the spark or ionization portion. The lower voltage portion of a pulse is referred to as the muscle portion.

CEWs may include at least two terminals at the face of the CEW. A CEW may include two terminals for each bay that accepts a deployment unit (e.g., cartridge). The terminals are spaced apart from each other. In the event that the electrodes of the deployment unit in the bay have not been deployed, the high voltage impressed across the terminals will result in ionization of the air between the terminals. The arc between the terminals is visible to the naked eye. When launched electrodes do not electrically couple to a target, the current that would have been provided via the electrodes may arc across the face of the CEW.

The likelihood that the stimulus signal will cause NMI increases when the electrodes that deliver the stimulus signal are spaced apart about six inches so that the current from the stimulus signal flows through six or more inches of target tissue. Preferably, the electrodes should be spaced apart twelve or more inches on the target. Because the terminals on a CEW are less than six inches apart, a stimulus signal delivered through target tissue via terminals likely will not cause NMI, only pain.

A series of pulses includes two or more spaced apart pulses. Each pulse delivers an amount of charge into target tissue. When electrodes that are appropriately spaced, the likelihood of inducing NMI increases when each pulse delivers an amount of charge in the range of 55 microcoulombs to 71 microcoulombs per pulse. The likelihood of inducing NMI increases when the rate of pulse delivery (e.g., rate, pulse rate, repetition rate) is between 11 pulses per second ("pps") and 50 pps. Pulses delivered at a higher rate may provide less charge per pulse to induce NMI. Pulses that deliver more charge per pulse may be delivered at a lesser rate to induce NMI. CEWs may be hand-held and use batteries to provide the pulses of the stimulus signal. When the amount of charge per pulse is high and the pulse rate is high, the CEW may use more energy than is needed to induce NMI. Using more energy than is needed depletes the battery more quickly.

Empirical testing has shown that the power of the battery may be conserved with a high likelihood of causing NMI when the pulse rate is less than 44 pps and the charge per pulse is about 63 microcoulombs. Empirical testing has shown that a pulse rate of 22 pps and 63 microcoulombs per pulse via a pair of electrodes will induce NMI when the electrode spacing is about 12 inches.

A system according to various aspects of the present disclosure includes a handle and one or more deployment units (e.g., cartridges). A handle includes one or more bays for receiving deployment units. A deployment unit may be positioned in (e.g., inserted into, coupled to) a bay. A deployment unit may releasably electrically and mechanically couple to a bay. A deployment unit may deploy one or more projectiles toward a target. Deploying the projectiles may be referred to as activating (e.g., firing) a deployment unit. Generally, activating a deployment unit deploys each projectile of the deployment unit, so the deployment unit may be activated only once to launch one or more projectiles. After use (e.g., activation, firing), a deployment unit may be removed from the bay and replaced with an unused (e.g., not fired, not activated) deployment unit to permit deployment of additional projectiles.

In a CEW, a deployment unit may deploy one or more electrodes toward a target to remotely deliver a stimulus signal through the target. A deployment unit for a CEW may include two electrodes that are deployed at the same time. Deploying the electrodes may be referred to as activating (e.g., firing) a deployment unit. Generally, activating a deployment unit deploys all of the electrodes of the deployment unit, so the deployment unit may be activated only once to deploy electrodes. After use (e.g., activation, firing), a deployment unit may be removed from the bay and replaced with an unused (e.g., not fired, not activated) deployment unit to permit deployment of additional electrodes.

FIG. 1 is a schematic diagram of a system 100 that deploys at least one projectile according to various aspects of the present disclosure. The system 100 may be a CEW. The system includes a housing 110 and one or more deployment units 120 (e.g., cartridges). Housing 110 includes a guard 130, trigger 140, microprocessor 150, battery 160, and signal generator 170. Microprocessor 150 couples to power supply 160 and signal generator 170 via one or more electrical conductors. A deployment unit 120 includes a propulsion module 180, first projectile 190, and second projectile 195.

A deployment unit 120 removably inserts into the housing 110. A deployment unit 120 removably inserts into one end of the housing 110. The housing may be shaped to be held in a hand of a user. A portion of the housing 110 may form a handle at an end generally opposite to an end at which a deployment unit 120 removably inserts.

Housing 110 as shown in FIG. 1 includes a guard 130. Housing 110 includes a trigger 140 disposed within the guard 130. The guard 130 may comprise an opening formed in housing 110. Guard 130 protects the trigger 140 from unintentional physical contact. Guard 130 may surround trigger 140 within housing 110. Trigger 140 may be actuated by physical contact applied the trigger from within the guard 130. Trigger 140 may move, slide, rotate, otherwise become physically depressed upon application of the physical contact. FIG. 1 shows guard 130 in a center region of housing 110, though the guard 130 and trigger 140 may be provided at other locations on housing 110.

Actuation of a trigger may be detected via a processing circuit. A processing circuit includes any circuitry and/or electrical or electronic component for performing a function. A processing circuit may include circuitry that performs (e.g., executes) a stored program. A processing circuit may include a digital signal processor, a microcontroller, a microprocessor, an application specific integrated circuit, a programmable logic device, logic circuitry, state machines, MEMS devices, signal conditioning circuitry, and/or communication circuitry.

A processing circuit may include passive electronic devices (e.g., resistors, capacitors, inductors) and/or active electronic devices (op amps, comparators, analog-to-digital converters, digital-to-analog converters, programmable logic, SRCs, transistors). A processing circuit may include data buses, output ports, input ports, timers, memory, and/or arithmetic units.

A processing circuit may provide and/or receive electrical signals whether digital and/or analog in form. A processing circuit may provide and/or receive digital information via a data bus using any protocol. A processing circuit may receive information, manipulate the received information, and provide the manipulated information. A processing circuit may store information and retrieve stored information. Information received, stored, and/or manipulated by the processing circuit may be used to perform a function, control a function, and/or to perform a stored program.

A processing circuit may control the operation and/or function of other circuits and/or components of a system such as a CEW. A processing circuit may receive status information regarding the operation of other components, perform calculations with respect to the status information, and provide commands (e.g., instructions) to one or more other components. A processing circuit may command another component to start operation, continue operation, alter operation, suspend operation, or cease operation. Commands and/or status may be communicated between a processing circuit and other circuits and/or components via any type of bus (e.g., SPI bus) including any type of data/address bus. A microprocessor 150 is illustrated in the example embodiment of FIG. 1, though other forms of processing circuits may alternately or additionally be employed by example embodiments of a system according to various aspects of the present disclosure.

In FIG. 1, actuation of the trigger may be detected by microprocessor 150. Microprocessor 150 is integrally disposed within housing 110. Microprocessor 150 may be coupled to trigger 140 to receive a signal upon actuation of the trigger 140. A signal may indicate that a trigger has been physically moved, rotated, or depressed to an extent sufficient to indicate that at least one projectile should be deployed from a system. The signal may be an electrical signal. The signal is detected by microprocessor 150. Microprocessor 150 may process a detected signal and perform a function of the system 100 in response to the received, detected signal associated with an actuation of trigger 140.

A microprocessor may be coupled to a battery or other form of power supply. Microprocessor 150 is coupled to power supply 160. Microprocessor 150 receives power from power supply 160. A power supply provides power (e.g., energy). For a CEW and other systems, a power supply provides electrical power. Providing electrical power may include providing a current at a voltage. Electrical power from a power supply may be provided as a direct current ("DC") or an alternating current ("AC"). A battery may perform the functions of a power supply. A power supply may provide energy for performing the functions of a CEW. A power supply may provide the energy for a stimulus signal. A power supply may provide the energy for other signals, including an ignition signal and/or an integration signal as further discussed below. A power supply may provide energy for operating the electronic and/or electrical components (e.g., parts, subsystems, circuits) of a system and/or one or more deployment units. The energy of a power supply may be renewable or exhaustible. A power supply may be replaceable. The energy from a power supply may be converted from one form (e.g., electrical, magnetic, thermal) to another form to perform the functions of a system. A power supply may be removably coupled to a housing. A power supply may be removed for recharging. A power supply may be recharged while the power supply is or is not coupled to a housing in which a processing circuit is included. A power supply may also be removed for servicing or other purposes.

Microprocessor 150 receives power from power supply 160. The power received from power supply 160 is used by microprocessor 150 to receive signals, process signals, and transmit signals to various other components. Microprocessor 150 may use power supply 160 to detect actuation of trigger 140 and generate one or more control signals in response to the detected actuation signal. A control signal may be provided by microprocessor 150 to signal generator 170 in response to detected actuation of trigger 140. Multiple control signals may be provided from microprocessor 150 to signal generator 170 in series.

A signal generator 170 provides an ignition signal to a propulsion module 180. Signal generator 170 receives one or more control signals from microprocessor 150. Signal generator 170 generates the ignition signal based on the received one or more control signals. Signal generator 170 is coupled to power supply 160. Signal generator 170 may use power received from power supply 160 to generate an ignition signal. Signal generator 170 may receive an electrical signal from power supply 160 that has first current and voltage values. Signal generator 170 may transform the electrical signal into an ignition signal with second current and voltage values. The transformed second current and/or the transformed second voltage values may be different from the first current and/or voltage values. The signal generator 170 may temporarily store power from the power supply 160 and rely on the stored power entirely or in part to provide the ignition signal. Signal generator 170 may not generate an ignition signal unless or until an instructional control signal is received from microprocessor 150. Signal generator 170 may be controlled entirely or in part by microprocessor 150. A control circuit within housing 110 may at least include signal generator 170 and microprocessor 150. A control circuit may also include other components and/or arrangements, including those that further integrate corresponding function of these elements into a single component or circuit, as well as those that further separate certain functions into separate components or circuits.

A signal generator may be controlled via control signals to generate an ignition signal with predetermined current value or values. For example, signal generator 170 may include a current source. A control signal may be received by the signal generator to activate the current source at a current value of the current source. An additional control signal may be received to decrease a current of the current source. For example, the signal generator 170 may include a pulse width modification circuit coupled between a current source and an output of the control circuit. A second control signal may be received by signal generator 170 to activate the pulse width modification circuit, thereby decreasing a non-zero period of a signal generated by the current source and an overall current of an ignition signal subsequently output by the control circuit. The pulse width modification circuit may be separate from a circuit of the current source or, alternately, integrated with a circuit of the current source. Various other forms of signal generators may alternately or additionally be employed, including those that apply a voltage over one or more different resistances to generate signals with different currents.

Responsive to receipt of a signal indicating actuation of trigger 140, a control circuit provides an ignition signal to deployment unit 120. For example, signal generator 170 may provide an electrical signal as an ignition signal to deployment unit 120. For a CEW, the ignition signal may be separate and distinct from a stimulus signal. For example, a stimulus signal in a CEW may be provided to a different circuit within a deployment unit 120, relative to a circuit to which an ignition signal is provided. Signal generator 170 may generate a stimulus signal for a CEW. Alternately, a second, separate signal generator, component or circuit (not shown) within a housing 110 may generate a stimulus signal for a CEW. Signal generator 170 may also provide a ground signal path for a deployment unit 120, thereby completing a circuit for an electrical signal provided to the propulsion module 180 by the signal generator 170. A ground signal path may also be provided to deployment unit 120 by other elements in housing 110, including power supply 160.

A deployment unit may receive an ignition signal. A deployment unit may include a propulsion module and a first projectile. For example, deployment unit 120 includes propulsion module 180 and first projectile 190. A CEW may further include a second projectile 195 in a deployment unit 120. The ignition signal may be coupled to a propulsion module 180. The ignition signal may cause the propulsion module to provide a propulsion force. A propulsion module is a device that provides a propulsion force. A propulsion force may include an increase pressure cause by rapidly expanding gas within an area or chamber. The propulsion force may launch a component within the deployment unit 120. The propulsion force may be directly applied to the component. For example, the propulsion force may be provided directly to first projectile 190 or second projectile 195. The propulsion force from an ignited propulsion module 180 may travel within a housing of deployment unit 120 to one or more projectiles 190, 195. The force may travel via a manifold in the deployment unit. The deployment unit 120 couples a propulsion force from the propulsion module 180 to projectiles 190,195.

Alternately, the propulsion force may be provided indirectly to a first projectile 190 or second projectile 195. For example, a propulsion force may be provided to a secondary source of propellant within the propulsion module 180. The propulsion force may launch the secondary source of propellant within the propulsion module 180, causing the secondary source of propellant to release propellent. A force associated with the released propellant may in turn provide a force to one or more projectiles 190,195. A force generated by a secondary source of propellent may cause projectiles to be deployed from the deployment unit 120 and system 100.

A projectile may include rigid, semi-rigid, or deformable material. A projectile may include combinations of such materials. A material of a projectile may be electrically conductive or non-conductive. For a CEW, a projectile may be or include an electrode. An electrode may include a spear portion, designed to pierce or attach proximate a tissue of a target in order to provide a conductive electrical path between the electrode and the tissue. For a CEW, two projectiles 190, 195 may each include a respective electrode. The projectiles 190,195 may be deployed from a deployment unit 120 and system 100 at the same time or substantially the same time. The projectiles 190,195 may be launched by a same propulsion force from a common propulsion module 180. A deployment unit 120 may include an internal manifold configured to transfer a propulsion force from a propulsion module to one or more projectiles. Alternately, each projectile in a deployment unit 120 may have its own respective propulsion module 180, wherein an ignition signal is provided to each individual propulsion module 180.

A housing includes a bay for each deployment unit. A bay includes a receptacle (e.g., chamber, holder, container, female fitting) positioned in the housing of a system. A bay accepts (e.g., receives, takes, holds) a deployment unit (e.g., cartridge). A deployment unit may be removably inserted (e.g., positioned, placed, attached) in a bay. A housing may include one or more bays that each receive a respective deployment unit.

For example, in FIG. 1, deployment unit 120 may be removably inserted into a bay of housing 110. A shape of the housing of deployment unit 120 may align with interior surfaces of the bay of housing 110. The shape of the housing and the interior surfaces of bay may guide the movement of deployment unit 120 during insertion into bay of housing 110. Once inserted, deployment unit 120 may be held in the bay by friction, interference of one surface with another surface, and/or a latch. Deployment unit 120 may be removed from bay. Removal may require a reduction in friction, removal of an interfering surface, and/or operation of a latch to permit deployment unit 120 to be extracted (e.g., pulled) from bay. Once deployment unit 120 is removed from bay a new or different deployment unit 120 may be inserted in to bay.

In embodiments according aspects of the present disclosure, multiple deployment units may be attached to each other prior to insertion in respective bays of a housing. Attached deployment units may be inserted into respective bays at a same time. Deployment units may be attached to each other in a separable manner. Multiple (e.g., two or more, three or more, four or more, five or more) may be attached to each other for storage or other handling. A number of attached deployment units may exceed a number of respective bays available on a housing. For example, three or more deployment units may be attached to each other, even though a housing includes two bays. Attached deployment units may not be inserted into the respective bays of a housing 110 when the number of attached deployment units exceeds a number of respective bays of the housing 110. The insertion may be prevented by a shape of the bays and/or housing of the system. When attached, the deployment units are provided at a relative orientation that permits them to be activated by the housing without changing, adjusting, or modifying their relative orientation.

Each attachable deployment unit may include a projection on a first side and a receptacle on a second side opposite the first side. The first and second sides may be parallel to each other. The first and second sides may be perpendicular from a side or sides of the deployment unit from which electrodes are deployed upon activation of the deployment unit. When attached, corresponding outer surfaces of deployment units, aside from the projections and receptacles, may be parallel to each other. For example, a surface of a deployment unit through which a projectile on a first deployment unit may be deployed may be parallel to a surface of a deployment unit through which a projectile on a second deployment unit may be deployed.

A projection and receptacle may have complementary shapes, such that a projection on one deployment unit may be inserted and attached in a receptacle on a second deployment unit. The complementary shape may include identical or nearly identical sizes and shapes provided between an outer surface of a projection and an inner surface of a receptacle. A projection and receptacle may be positioned on symmetrically opposite locations on first and second sides of a deployment unit. A projection may extend between 1 centimeter and 0.5 centimeters from the first side. Similarly, a receptacle may extend between 1 centimeter and 0.5 centimeters in the second side of the deployment unit. A thickness and width of the projection and receptacle may each be between 1 centimeter and 0.25 centimeters. A first side of a deployment unit may include multiple projections and a second side of the deployment unit may include multiple correspondingly shaped and positioned receptacles, allowing multiple deployments to be attached (e.g., press fit) in a side by side manner.

A projection and receptacle may be integrated into a casing of each deployment unit. The casing, projection, and receptacle may comprise a plastic material. Once attached, two deployment units held together by friction, interference of one surface with another surface, and/or a latch. The friction, interference, or latching may be provided between a projection of one deployment unit and a receptacle of a second deployment unit of attached deployment units. A deployment unit may be unattached or disengaged from another deployment unit. Unattachment may require a reduction in friction, removal of an interfering surface, and/or operation of a latch to permit one deployment unit to be extracted (e.g., pulled) from another deployment unit.

Figure 2:
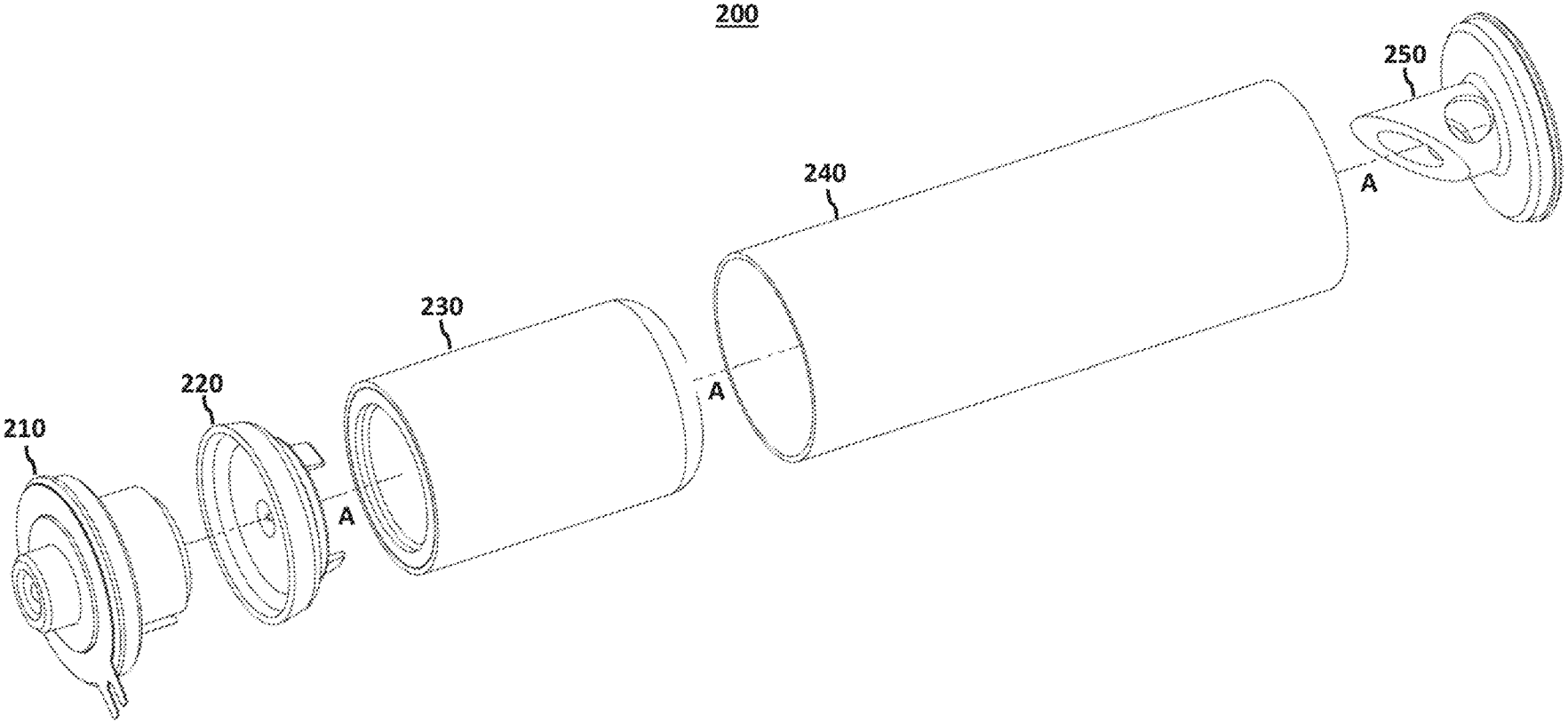
FIG. 2 is an illustration of an example embodiment of a propulsion module according to various aspects of the present disclosure.

As discussed above, a propulsion module may provide a force to directly or indirectly deploy a projectile from a system. In the example embodiment of FIG. 2, propulsion module 200 includes an ignition device 210, gasket 220, a propellent capsule 230, housing 240, and puncture pin 250. FIG. 2 also shows a center axis A. These components are shown spaced apart along axis A for purposes of illustration and discussion. In use, these components of FIG. 2 are further assembled and integrated with each other along axis A. When assembled, gasket 220 and capsule 230 may be fully enclosed within housing 240, while ignition device 210 and puncture tip 250 may be partially integrated into housing 240. When assembled, gasket 220 and capsule 230 may be movable within housing 240, while ignition device 210 and puncture tip 250 may be rigidly mounted to housing 240.

A housing may comprise a support can. A housing may be made of a metal or other material(s) sufficiently rigid to not deform in response to pressures or motion of a component disposed within an inner bore of the housing. The housing may also protect components disposed within an inner bore of the housing during transfer of a propulsion module and assembly of a propulsion module with other components of a device or system. In FIG. 2, housing 240 includes a hollow cylinder. Other shapes may alternately or additionally be employed.

An ignition device provides a propulsion force. An ignition device provides a propulsion force in at least one direction. In FIG. 2, ignition device 210 provides a propulsion force along axis A. The ignition device 210 provides a propulsion force toward a gasket 220. The propulsion force may be provided by rapidly expanding gas emitted by an ignition device. A propulsion force may be provided at least in part by physical movement of a portion of an ignition device that rapidly separates from another portion of the ignition device upon activation of the ignition device. The movement of the portion of the ignition device may transfer a propulsion force to another component of a propulsion module. Details of an example ignition device are further discussed with respect to FIG. 3-5.

A gasket seals one section of a propulsion module from another section of the propulsion module. A gasket may provide a complete seal between two sections of a propulsion module. A complete seal may control transfer of a propulsion force between sections of a propulsion module. A gasket may be moved in a controlled manner within a propulsion module. Control of movement of a gasket may be imparted by a physical design of the gasket. Movement of a gasket is caused by a propulsion force applied to one side of a gasket. Application of a propulsion force to one side of a gasket launches the gasket in a direction opposite from which the propulsion force is applied. In the example of FIG. 2, gasket 220 has a first side proximate ignition device 210 and a second side proximate capsule 230. Gasket 220 may include semi-rigid and/or flexible materials. The materials are sufficient to maintain overall structural integrity upon application of the propulsion force. The first side of the gasket is opposite the second side of the gasket as illustrated in FIG. 2. The first side of the gasket 220 includes a flexible rim. This rim extends from a first surface of the gasket 220 parallel to axis A. The rim of gasket 220 reinforces a shape of the gasket. The rim of gasket 220 may also help seal a region on a first side of gasket 220 from the second side of gasket 220 upon application of a propulsion force from ignition device 210. The second side of gasket includes a shoulder and protrusions. A shoulder may include a junction between two portions of common component with different radii from a common reference line within a reference plane. A protrusion includes a portion of a common component that extends outwardly from a surface of another portion of the component. The second side of gasket 220, as shown, includes an outer shoulder and multiple flanges positioned and shaped to align with corresponding surfaces of capsule 230. Such features provide and retain concentric alignment between the gasket 220 and capsule 230 during assembly. Such features also support alignment of the gasket 220 and capsule 230 upon application of a propulsion force from ignition device 210. Gasket 220 and capsule 230 are objects launched by the propulsion force from ignition device 210. Gasket 220 and capsule 230 are launched within the housing 240. Gasket 220 and capsule 230 may move together within housing 240 in response to firing of the ignition device 210. An outer diameter of capsule may be slightly less than a diameter of a housing in which it is provided, thereby permitting stable travel of the capsule within the housing.

A capsule provides a secondary source of propellant within a propulsion module. The capsule may contain a gas under pressure. A capsule may alternately or additionally include a chemical substance that generates a gas upon under a select condition. A capsule may release or generate a gas in response to actuation. Actuation may comprise a force that ruptures the capsule. In FIG. 2, the capsule 230 may be actuated by a propulsion force generated by ignition device 210. The propulsion force may be applied to the capsule 230 via the gasket 220. The propulsion force may cause the gasket 220 and capsule to move within the housing 240 to contact puncture tip 250. The force may cause an end of the puncture tip 250 proximate the capsule 230 to pierce or rupture a wall of the capsule 230. Upon rupture, the capsule 230 may generate, release, or otherwise produce gas within housing 240 and outside capsule 230. The produced gas increases a pressure within the housing 240. A housing may release such gas and its associated pressure via one or more openings.

A puncture tip may provide a sharp edge to pierce, rupture, or otherwise puncture an object with which the puncture tip comes in contact. In the example of FIG. 2, puncture tip 250 includes a hollow bore needle tip. A point of the needle tip is oriented toward capsule 230 along axis A within housing 240. A central, hollow bore is provided within the needle tip. This bore extends through the length of the puncture tip 250 along axis A. The bore thus provides an opening though which gas produced by capsule 230 may be expelled. Additional bores are provided on one or more side surfaces of the needle tip, thereby providing additional pathways though which gas produced by the capsule 230 may be provided to a center bore of the puncture tip 250. The puncture tip 250, as shown, may also include a base portion to which a needle tip portion is attached. The base portion of puncture tip 250 has an outer diameter that is a same or similar size as a diameter of housing 240, thereby permitting the puncture tip 250 to be secured in a gas impermeable matter to housing 240 via the base portion. In some embodiments, the base portion may include alternate or additional openings through which produced gas may be expelled from the propulsion module 200. Gas or other propellant expelled from a propulsion module may provide a propulsion force to a projectile. This propulsion force may be indirect or secondary relative to a propulsion force provided by ignition device 210.

In the example embodiment of FIG. 2, a propulsion force for a projectile is provided indirectly from an ignition device to a projectile. For example, a propulsion force from ignition device 210 is applied to a secondary source of propellant, capsule 230, which in turn provides another force that is subsequently applied to a projectile.

In other embodiments, a propulsion force from an ignition device may be applied directly to a projectile. For example, a propulsion module according to such embodiments may include a projectile instead of a capsule. In the example embodiment of FIG. 2, such an alteration may include replacing capsule 230 with the projectile. Such an example alteration may or may not also involve replacing puncture cap 250 with solid end cap which may or may not be planar and may or may not include an opening connecting an inner chamber of a housing with a space external to the housing. In other embodiments, capsule 230 and puncture tip 250 may be simply removed, allowing a propulsion force from an ignition device to be directly coupled to one or more projectiles via tubing or other channels within a deployment unit.

In embodiments involving direct application of a propulsion force from an ignition device to a projectile, the projectile would be a component launched within the system by the propulsion force generated by the ignition device, rather than a capsule. Such arrangements may or may include at least a housing in which an ignition device and a projectile are at least partially disposed prior to firing of the ignition device. The housing may commonly at least partially enclose both the ignition device and a projectile. The housing may be a housing of a propulsion module or, alternately, a housing of a deployment unit. A deployment unit, according to such embodiments, may include multiple propulsion modules, one for applying a propulsion force directly to each projectile of the deployment unit. Each housing may provide a sealed chamber in which a propulsion force from an ignition device may be directly coupled or applied to one or more projectiles, thereby launching the projectiles within the housing and subsequently deploying the projectiles from the system. In a CEW, projectiles comprising electrodes may be directly launched in response to firing of an ignition device. In a direct application, a propulsion force from an ignition device may provide most or all of the energy to a projectile that causes the projectile to be deployed from a system. A secondary source of propellent or other energy is not necessary or at least not a sole source of energy employed by the system to deploy the projectile. A gasket or other non-energized components may or may not be included in such embodiments. Any such non-energized components may transfer energy from an ignition device to a projectile, though they would not provide an additional source of energy for deploying a projectile from the system, aside from the energy provided by the ignition device itself. Example embodiments according to aspects of the present disclosure include both manners, direct and indirect, of causing a projectile to be deployed from a system.

Figure 3:
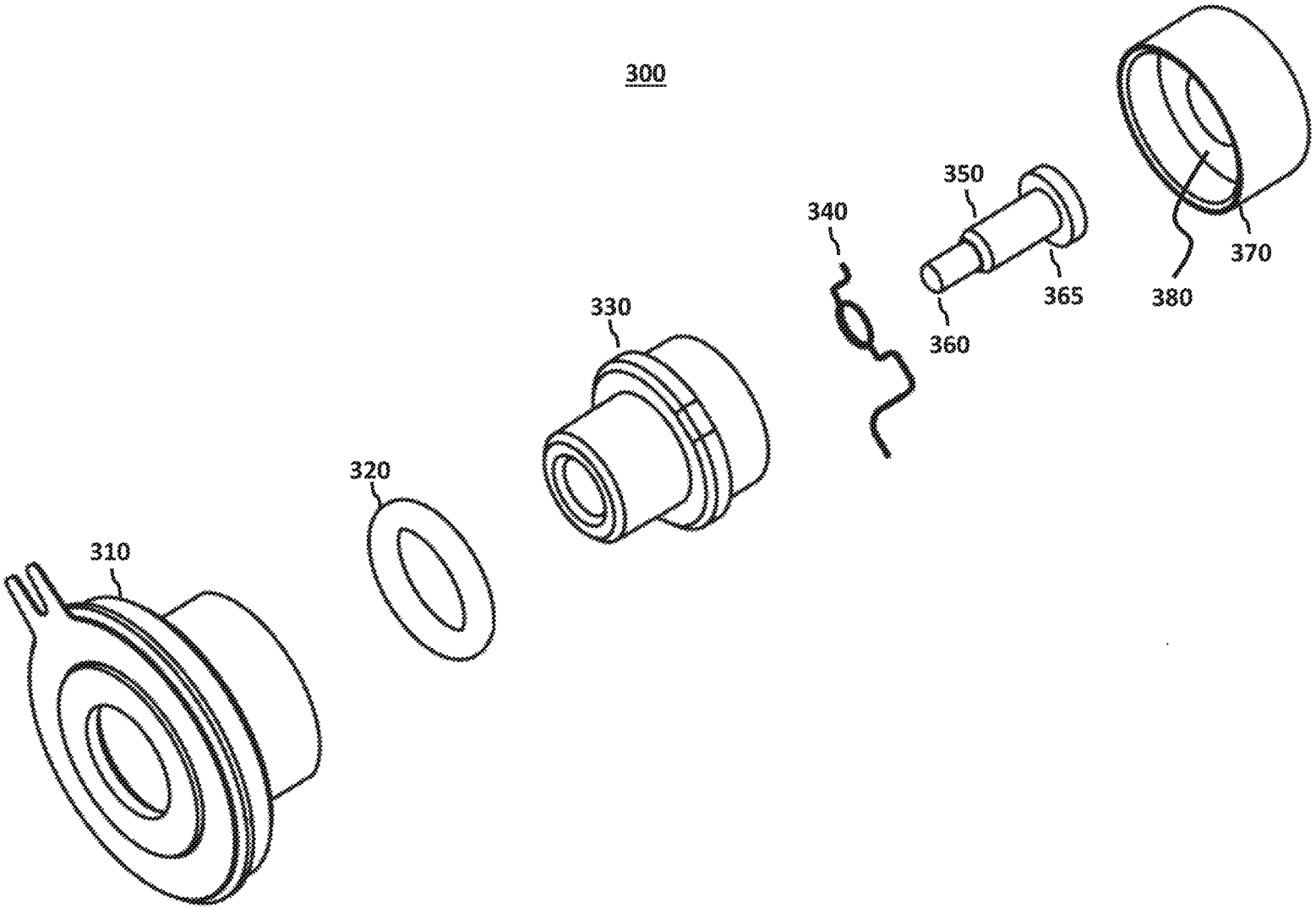
FIG. 3 is an illustration of an example embodiment of an ignition device according to various aspects of the present disclosure.

As noted above, an ignition device provides a propulsion force. An ignition device provides a propulsion force in at least one direction. The propulsion force may be provided by rapidly expanding gas emitted or expelled by an ignition device. A propulsion force may also include any impact force associated with movement of a portion of the ignition device that is rapidly separated from another portion of the ignition device upon firing. FIG. 3 illustrates an example embodiment of an ignition device according to aspects of the present disclosure.

Ignition device 300 includes an ignition cap 310, a circular gasket 320, an insulator 330, a conductor 340, an ignition pin 350 with a proximal end 360 and a distal end 365, a primer cup 370, and primer material 380. These elements are shown spaced apart along a center axis for purposes of illustration and discussion. In use, these elements would be further assembled with each other along the center axis. This center axis may be a same axis A shown in FIG. 2. Relative to a common center axis, a maximum outer radius of insulator 330 may be greater than a maximum outer radius of ignition pin 350 at end 365, a maximum outer radius of primer cup 370 may be equal or greater than the maximum outer radius of ignition pin 350, and a maximum outer radius of ignition cap 310 may be greater than a maximum outer radius of the primer cup 370. Other relative relationships between outer dimensions of different components in an ignition device 300 may also be provided in other example embodiments according to aspects of the present disclosure. When integrated, ignition cap 310 and primer cup 380 at least partially enclose each of the other components shown in FIG. 3. The ignition cap 310 and primer cup 380 may collectively secure the other components within the ignition device, preventing movement of such components until firing of the ignition device.

An ignition cap includes a mounting structure to which a primer cup and other components may be secured. An ignition cap may form one end of a chamber in a propulsion module in which a propellent is provided and subsequently expelled. An ignition cap may be impermeably sealed to a housing or other components forming a wall of such a chamber. An ignition cap may also provide an electrical path through which an electrical signal may be provided.

The ignition cap 310 of FIG. 3 includes a first, base portion and a second, inner receptacle portion. As illustrated, the first portion and second portion of the ignition cap meet at a shoulder, the base portion having a larger radius from a center axis relative to a radius of the inner receptacle portion. A base portion of the ignition cap 310 may include a conductive material. This conductive material may provide a part of a signal path within the ignition device. The base portion may be made or partially formed from metal. A base portion may provide an outer surface for an ignition device upon assembly thereof. A base portion may also provide an outer surface of a propulsion module in which an ignition device with the ignition cap is included. An inner receptacle portion of the ignition cap 310 may receive at least part of insulator 330, ignition pin 350, conductor 340, and primer cup 370 upon assembly the ignition device 300. In other embodiments, at least an ignition pin and insulator may be provided within an inner receptacle portion of an ignition cap.

A circular gasket ensures that a gas-impermeable seal is formed between two components. A circular gasket may comprise one or more deformable materials. A circular gasket may have an outer surface with a torus shape, though other three-dimensional, circular shapes may be employed. Gasket 320 has a torus shape. Upon assembly of the ignition device 300, gasket is compressed between rigid, corresponding surfaces of ignition cap 310 and insulator 330.

An insulator may comprise a structure that aligns other components in an ignition device. An insulator may comprise one or more non-electrically-conductive materials. An insulator may also resist deformation in response to an applied propulsion force, ensuring that the force and any associated gas or other propellent are directed, expelled, or expand in or toward a different direction or component. An insulator may provide electrical separation between different elements that provide an electrical signal path within an ignition device. For example, insulator 330 in FIG. 3 provides electrical separation between an ignition cap 310 and an ignition pin 350. In such an arrangement, an ignition signal provided to an ignition pin 350 reaches the ignition cap 310 via conductor 340, rather than locations on the ignition pin 350 and ignition cap 310 between which the insulator 330 is disposed upon assembly of the ignition device 300. Insulator 330 includes an inner bore in which an ignition pin 350 is disposed upon assembly of the ignition device 300. Insulator 310 includes three different portions extending radially along a center axis, though other embodiments of the insulator may include more or fewer such portions. Different portions may have different radii, forming a shoulder at each junction between adjacent portions. An insulator may at least include a first portion sized to fit within an inner radius of a primer cup. A difference between an outer radius of this first portion of an insulator and an inner radius of a primer cup may be selected to match or substantially match a diameter of a conductor, such as conductor 340, which may be disposed between the first portion of the insulator and the primer cup upon assembly of the first portion within the primer cup. Another portion of an insulator may be sized with an outer radius to fit within and through a corresponding opening or inner bore in an ignition cap upon assembly.

A conductor is a material or object through which an electric current or signal may flow. A conductor provides a path for propagation of an electric current or signal. A conductor may provide a desired (e.g., intended) path for flow of a current or signal. A conductor may provide a part of a path for a signal generator to send an ignition signal through an ignition device. Conductor 340 is an electrical conductor. Conductor 340 provides a desired signal path between an ignition pin 350 and an ignition cap 310. A conductor may include a wire. For example, conductor 340 may include a nichrome wire. Conductors in other embodiments may comprise alternate or additional conductive materials. A conductor may contact a conductive component at a first end and a second conductive component at a second end, providing an electrical path between the two conductive components. A conductor may be affixed to either or both conductive components. For example, a conductor may be spot welded to another conductive component. Alternately or additionally, a conductor may encircle another conductive component, providing physical contact between the conductor and the conductive component. For example, a loop is shown for conductor 340 that encircles a portion of ignition pin 350 upon assembly of the ignition device. In other embodiments, conductor 340 may be electrically coupled to ignition pin 350 using other manners, such as spot welding. A conductor may have a length and diameter, wherein a length of the conductor comprises an elongated dimension of the conductor, substantially greater than either other dimension corresponding to a width or diameter of the conductor. A conductor may have a predetermined diameter. For example, conductor 340 may have an American wire gauge (AWG) value between 36 and 40. Conductors of other embodiments according to aspects of the present disclosure may have different thicknesses, including those above or below the ranges listed above and/or those that vary along a length of the conductor.

In example embodiments according to various aspects of the present disclosure, an ignition signal may comprise a single current value, multiple current values, or a continuously changing current value. For example, an ignition signal with a constant current of at least 1 Amp may be applied to an electrical conductor, causing the electrical conductor to increase to a temperature equal or greater than an autoignition temperature of a nearby primer material. Parameters of a conductor may be adjusted to achieve such a temperature increase. For example, a thickness of the wire may be selected that has a gauge outside the range of 36 to 40 American wire gauge (AWG), thereby achieving an increase in temperature and at least in ignition temperature for the conductor upon conduction of an ignition signal with a predetermined current. Also, a material may be employed for the electrical conductor that has different resistance, heat transfer, or other characteristics compared to nichrome, while still achieving an increase in temperature and at least in ignition temperature for the conductor upon conduction of an ignition signal with a predetermined current.

An ignition pin comprises an electrically conductive component. An ignition pin may receive an ignition signal in an ignition device. An ignition pin may provide an electrical path between an ignition signal source and other elements within an ignition device. For example, ignition pin 350 may couple an ignition signal received at a first, proximal end 360 to a conductor 340 electrically connected to the ignition pin 350 at a second, distal end 365 of the ignition pin 350. An ignition pin may be separated from other conductive elements in the ignition device aside from a conductor, so as to establish a desired path for a received ignition signal. An ignition pin may be sized to be received within an inner bore of an insulator and an inner bore of an ignition cap upon assembly of an ignition device. An ignition pin may also be sized to fit within a concave region of a primer cup. A diameter of each of one or more portions of the ignition pin may be selected to not contact these other components, except for the insulator. An ignition pin may include a portion along a center axis of the ignition pin selected to be greater than a diameter of another element in which the ignition pin is disposed, thereby preventing the ignition pin from sliding past a certain length within the inner bore of the other element.

For example, ignition pin 350 includes a portion at distal second end 365 that presents the pin from being slid entirely within an inner bore of insulator 310. An ignition pin and a conductor in an ignition device may be separate components. For example, FIG. 3 illustrates ignition pin 350 as being separate from conductor 340. The separate components may be electrically coupled. In these embodiments, the ignition pin and the conductor may comprise different materials and/or different shapes. The ignition pin may comprise a rigid material, while a conductor may comprise a flexible or deformable material. An ignition pin may comprise a non-wire material have a solid, non-wire structure. In other embodiments according to aspects to the present disclosure, the function of an ignition pin and a conductor may be performed by a same physical component. When implemented with a same component, portions of a same physical component may be permanently adjoined to each other and/or each portion may consist or comprise a same material or combination of materials. In many embodiments according to various aspects of the present disclosure, a component that receives a signal and a component that increases in temperature in response to the signal are separate components, thereby allowing a signal to be received and a temperature to be increased at separate locations within an ignition device.

Compared to a conductor, an ignition pin may have an average diameter that is substantially larger than an average diameter along a length of a conductor. For example, an average diameter of an ignition pin along a longest dimension between a first end and a second end may be at least four times greater than an average diameter of a conductor along a longest dimension of the conductor. Such relative dimensions are illustrated in the example embodiment shown in FIG. 3.

A primer cup comprises walls and a base. The walls and a base form a concave region partially enclosed by the walls and the base. In FIG. 3, walls of primer cup 370 are cylindrical, while the base is circular in shape and adjoins the walls along its outer diameter. A primer cup may comprise metal. An entire primer cup may be formed of metal. A primer cup contains a primer material disposed within the concave region formed in the primer cup. For example, primer cup 370 includes primer material 380. The primer material may partially fill the concave region of the primer cup. A shallow, recessed area may be provided at a central region of a surface of the primer material, the central region not in contact with the base or walls of the primer cup. A surface of the primer material not in contact with walls or a base of the primer cup, except at its periphery, may be referred to as a contact surface of the primer material, able to be placed in physical contact with other elements in an ignition device, aside from a primer cup. As indicated in FIG. 3, the recessed region may not extend across an entire diameter of the contact surface of the primer material 380. A portion of the contact surface outside the center, recessed area or central region may be planar in shape.

Primer material is a pyrotechnic composition. The primer material includes one or more pyrotechnic substances. The primer material may be ignited responsive to an applied temperature. An applied temperature may include an increased temperature compared to an ambient temperature of an environment in which the primer material is disposed prior to application of the increased temperature. The applied temperature may transfer energy to the primer material in the form of heat. Upon application of a temperature sufficient to heat the primer material above an autoignition temperature, the primer material ignites. Ignition of the primer material produces a rapidly expanding gas. A force of the rapidly expanding gas may be used directly or indirectly to deploy one or more projectiles. A force of the rapidly expanding gas may be used to pierce a capsule to release another rapidly expanding gas, which in turn deploys one or more projectiles.

The primer material may include one or more of a variety of materials. The primer material produces a rapid expansion of gas upon ignition. This gas creates a propulsion force. The propulsion force may separate a primer cup from another element to which the primer cup was disposed against or secured to prior to ignition of the primer material within the primer cup. In FIG. 3, ignition of the primer material 380 may cause primer cup to separate from an inner receptacle portion of an ignition cap 310. Primer materials may include matchhead powder, gun powder, zirconium-potassium perchlorate, lead styphnate, sulfur potassium perchlorate or other pyrotechnic compositions.

In embodiments according to various aspects of the present disclosure, a barrier may also be provided between a contact surface of a primer material and a conductor. A barrier may be included or excluded from an ignition device. The barrier may cover an entire contact surface of the primer material. Alternately, the barrier may cover less than an entire contact surface of primer material, though at least a central region of the contact surface. The barrier may cover at least a central region greater than a shallow, recessed portion of the contact surface if the contact surface includes such a center feature. The barrier may comprise paper. The barrier may comprise paper to which a shellac or other coating material has been applied. The barrier reacts to an applied temperature differently than the primer material. A barrier may partially combust, but not ignite in a manner that results in the rapid production of expanding gas as provided by the primer material. Heat transferred to the primer material may be transferred from a source of the heat through the barrier. The barrier is a physical and visual barrier over the contact surface of the primer material, but not a thermal barrier. The barrier may be deformable, conforming to a shape of a contact surface of primer material. The barrier may be non-conductive, but combustible. A barrier does not have a conductivity equal or greater than an adjacent conductor, such that an electrical signal in the conductor remains in the conductor or the barrier increases the likelihood that the signal remains in an intended signal path, rather than passing into or through the barrier. A barrier may be planar or substantially planar in shape. The barrier may have a first side and a second side opposite the first side. A barrier may have a thickness between the two sides of less than 0.05 millimeters (mm), less than 0.1 mm, less than 0.2 mm, or less than 0.3 mm. When provided, a barrier may be in direct physical contact on a first side with at least a conductor and in direct physical contact on a second side with primer material. A first side may also contact other components in an ignition device, aside from the conductor. For example, a first side of a barrier may also contact an ignition pin, depending on assembly of an ignition device.

Figure 4:
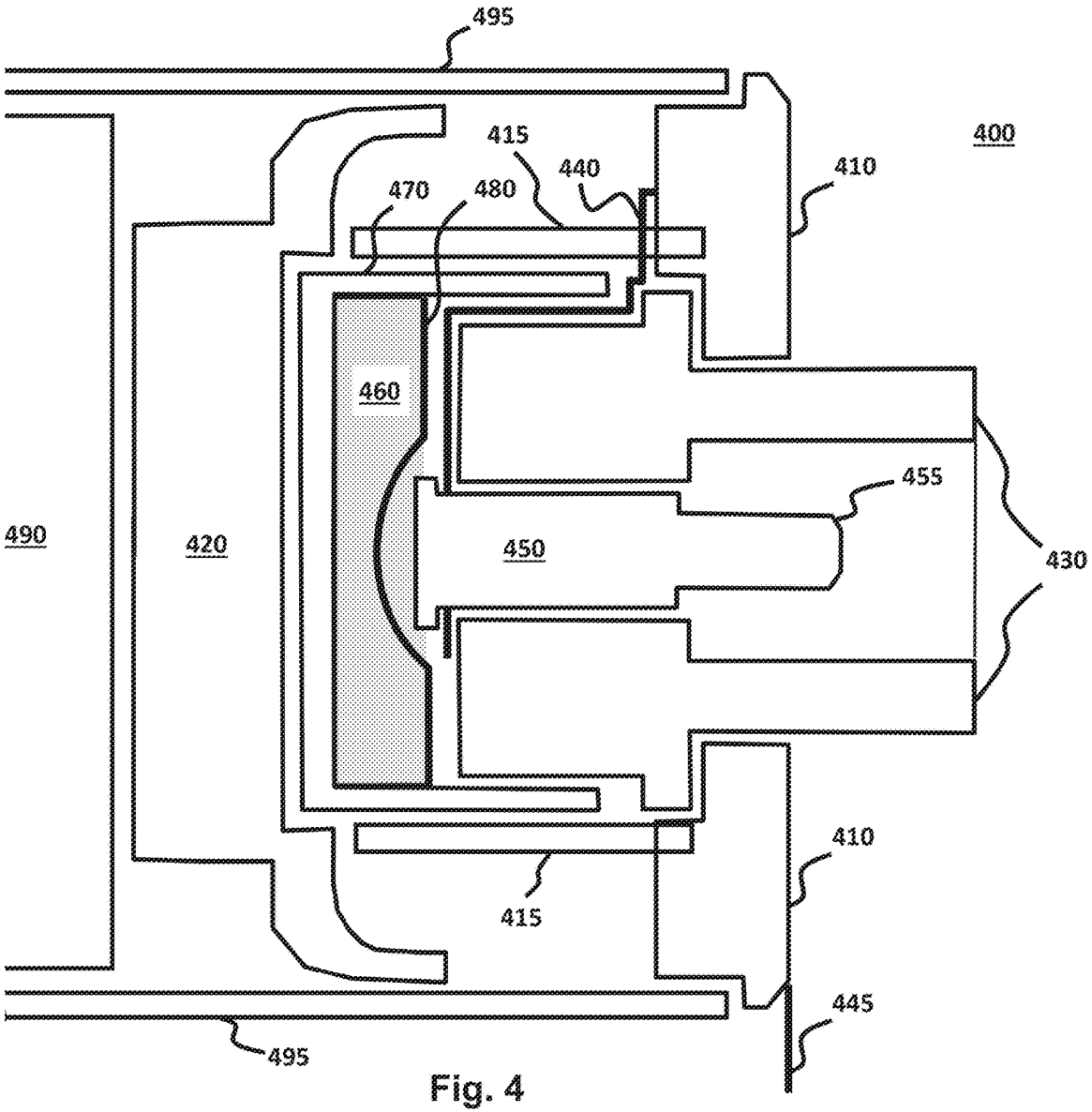
FIG. 4 is an illustration of a cross-section of an example embodiment of a propulsion module according to various aspects of the present disclosure.

Example embodiments according to various aspects of the present disclosure may not include a barrier positioned between the conductor and the primer material. In such embodiments, an elongated surface of the electrical conductor may be in direct physical contact with the primer material. An air gap or other intermediate substance is not disposed between the primer material and the conductor. A first portion of a surface of the electrical conductor provides direct physical contact between the conductor and the primer material. Another, separate portion of a surface of the conductor may remain physically separated and not in physical contact with the primer material. The separate portion on the conductor opposite the first portion may be in physical contact with another element, aside from the primer material. When a barrier is not provided, the primer material may not fully enclose the electrical conductor. The electrical conductor is not entirely disposed within the primer material. The conductor does not conduct an ignition signal into or through a surface of the primer material, despite physical contact between the conductor and the primer material. A portion of a surface of the electrical conductor may be disposed in contact with a fourth component separate from a primer material, a source of the ignition signal, and an element that provides a ground path for the ignition signal from the conductor. For example, a portion of a surface of the electrical conductor may be disposed in contact with an insulator as shown in FIG. 4. A portion of a surface of the electrical conductor may be disposed in contact with another component that is neither the primer material or a conductive component within the ignition device.

Upon assembly, components of a propulsion module are coupled in a close manner. Assembled, proximate components may be disposed with little space or no space between each component. Each component has or may have a surface that contacts an adjacent surface of a proximate component. These surfaces may be complementary in shape, providing full or at least substantial contact across respective surfaces of the components. Assembled, relative positions of components in a propulsion module in an example embodiment according to various aspects of the present disclosure are shown in FIG. 4. Propulsion module 400 includes ignition cap 410, gasket 420, insulator 430, conductor 440, ground tab 445, ignition pin 450, first end 455 of ignition pin 450, primer material 460 (shaded), primer cup 470, barrier 480, projectile 490, and housing 495. An ignition device may comprise ignition cap 410, insulator 430, conductor 440, ground tab 445, ignition pin 450, primer material 460, primer cup 470, and barrier 480. Ignition cap 410 and housing 495 are assembled in an impermeable manner to provide external surfaces of the propulsion module 400. A surface of the ignition cap 410 provides as an end surface of the propulsion module 400. An outer surface of housing 495 provides side surfaces of propulsion module 400. The ignition cap 410 and housing 495 may further provide an inner chamber in which other components are disposed upon assembly. The ignition cap 410 includes a base portion through which the end surface of the propulsion module 400 is provided. The ignition cap 410 may also include inner receptacle portion or structure 415. The structure 415 includes projections that extend from the base portion. The structure 415 receives, aligns, and retains other elements within cap 410. The structure 415 may have a cylindrical shape. The structure 415 may have one or more gaps or openings. A conductor 440 may extend from an inner bore of the ignition cap 410 and structure 415 to an area outside structure 415 via such a gap or opening. An end of the conductor 440 may be spot welded on an external surface of the base portion of the ignition cap 410, outside an area of or enclosed by the inner receptacle structure 415 of ignition cap 410. A diameter of a base portion of ignition cap 410 may generally be greater than a diameter of the structure 415 as generally shown in FIG. 4 relative to a center axis of ignition cap 410, though other relative dimensions may also be provided while still providing the overall functions and utility of various portions of ignition cap 410. One or more components may be disposed within an inner bore of an ignition cap 410. Such components may be received within an inner bore of inner receptacle structure 415 of ignition cap 410 and/or base portion of ignition cap 410. For example, primer cup 470 is received within an inner bore of inner receptacle structure 415 of ignition cap 410, but not an inner bore of a base portion of ignition cap 410.

Ignition cap 410 may be electrically conductive. Ignition cap 410 may be formed of a conductive material, such as a metal, or alternately, may have conductive portion(s) provided in the ignition cap 410. A ground tab 445 is provided on a base portion of ignition cap 410. The ground tab 445 comprises a conductive projection extending from ignition pin 450. The ground tab 445 provides an electrical path for a signal received at a first location on ignition cap 410 through the ignition cap 410 and to ground tab 445. Protrusion of a ground tab from an ignition cap enables the ground tab to contact a corresponding signal path and connector for an ignition signal source or other electrical component in a device external to the propulsion module.

An insulator may be received within an inner bore of an ignition cap. In FIG. 4, insulator 430 extends and is disposed within an inner bore of both an inner receptacle structure 415 of ignition cap 410 and base portion of ignition cap 410. The insulator 430 is disposed in contact or close proximity with various surfaces of an inner bore of the ignition cap 410. A circular gasket (not shown) may be provided between two corresponding surfaces of an insulator and ignition cap, thereby providing a seal between the surfaces. Insulator 430 further includes an inner bore. An ignition pin may be provided within this inner bore. An electrical signal path provided by the ignition pin may be electrically insulated by the insulator from a signal path that exists in an ignition cap and ground tab. Each portion of an insulator and ignition pin may have a cylindrical shape relative to a center axis, though other concentric and/or complementary shapes may alternately be employed.

Ignition pin 450 contacts a conductor 440 at one end. This contact provides a conductive, electrical signal path between the ignition pin and conductor. An opposite end of an ignition pin may be spatially separated from an insulator. For example, end 455 is spaced apart from insulator 430. An ignition signal may be provided through this end 455. An electrical connector of an ignition signal source or other external component (not shown) may be brought into contact with end 455, thereby providing a conductive, electrical signal path between the ignition pin and the electrical connector of the ignition signal source. The electrical connector may be a socket-type connector, shaped to engage outer surface(s) of end 455 of ignition pin 450.

Collectively, end 455, ignition pin 450, conductor 440, ignition cap 410 and ground tab 445 provide a circuit through the propulsion module. The provided circuit is a complete circuit. These components are separate from and external to a primer material, yet enable the primer material to ignite upon receipt of an ignition signal. These components are disposed outside the primer material. These components are each entirely disposed externally relative to an outer surface or surfaces of the primer material. A path or circuit for the ignition signal through the primer material is not provided by this circuit. The primer material does not form a part of this circuit. The ignition signal is conducted externally from the primer material. The ignition signal is conducted outside the primer material. The ignition signal is conducted by the conductor and other electrical components beyond the boundaries or confines of the primer material. All current of an ignition signal may be conducted by the conductor beyond the boundaries or confines of the primer material, including as it may be disposed within a primer cup. The primer material ignites in response to an ignition signal without or independent of the application of any current to the primer material itself.

A conductor couples a component of an ignition device at which an ignition signal is received to a component from which a signal is transmitted from the ignition device. A conductor conducts an ignition signal outside the primer material. For example, conductor 440 electrically couples an ignition pin 450 and an ignition cap 410. Between these two components, a first portion of conductor 440 is retained between a primer cup 470 and insulator 430. Another portion of conductor is secured in place between an insulator and a primer material. The conductor 440 may be disposed in direct, physical contact on a surface of the primer material 460. Alternately, if a barrier is provided, the conductor may be disposed in direct physical contact with a surface on a first side of the barrier, where another surface on a different, opposite side of the barrier is in direct physical contact with primer material. In such embodiments, the other portion of the conductor may be secured in place between an insulator and the first side of the barrier.

For either adjacent surface of the primer material or barrier, the conductor may extend from an edge of the surface to a central region of the surface. The central region may correspond to a recessed region of the primer material or barrier. A central region may be defined as a region on a surface of a primer material or barrier within a distance from a center point of the surface, the distance being equal or less than half of a distance from the center point to an edge of the surface. The conductor may not extend to or beyond the center point within the central region of the surface. For example, as shown in FIG. 4, an upper portion of conductor extends from an edge of a surface of primer material 460 and barrier 480, but not beyond a center point of a recessed region of the primer material 460 and barrier 480 before entering a recessed area under a portion of ignition pin 450. Upon assembly, an end of the conductor 440 in contact with ignition pin 450 would not be exposed for contact with a primer material 460 or barrier 480. An example relative position of a conductor with respect to other components in an example ignition device is further illustrated in FIG. 5, which shows an example embodiment according to various aspects of the present disclosure.

A conductor may only be provided adjacent one surface of the primer material. For example, the electrical conductor 440 may only be provided next to or adjoining a surface of the primer material 460 that is not in contact with wall or a base of a primer cup 470 in which the primer material is disposed. If a barrier 480 is provided, the conductor 440 may only be adjacent to a surface of the primer material 460 on which the barrier 480 is provided. A primer cup 470 may not be disposed between conductor 440 and primer material 460. This arrangement may ensure that an ignition signal is provided along a desired path within conductor 440, rather than other paths that may be available or inadvertently be formed via other components, such as primer material 460 and/or primer cup 470.

With or without a provided barrier, conductor is adjacent (e.g., next to or adjoining) the primer material. When a barrier is provided, the conductor is adjacent the primer material and the barrier and not separated from the primer material by a distance greater than the thickness of a barrier. A thickness of a barrier may be less than 0.05 millimeters (mm), less than 0.1 mm, less than 0.2 mm, or less than 0.3 mm. Such relative, immediate proximity between a conductor and primer material promotes efficient and rapid transfer of heat generated by a conductor and received into the primer material. When a conductor is adjacent a primer material, more energy may be transferred from the conductor to the primer material than when the conductor is farther from the primer material for a same temperature of the conductor.

A conductor may be disposed along a surface of another component. Such an arrangement is distinct from other relative orientations between two components. For example, a component along another component is different from two components that may be provided at each other or into each other. For example, a conductor may have a length, thickness and width, where a length is substantially greater than the width or thickness. In such an arrangement, a conductor is positioned along a surface when a surface of the conductor that is in contact or in closest proximity to the surface of the component extends parallel to a length dimension of the conductor or at least a length dimension of a portion of the conductor.

A conductor may be provided along a continuous portion of an adjacent surface of a barrier or primer material. The continuous portion may be oriented in a radial direction along this surface. The continuous portion may be linear or substantially linear. The continuous portion may be elongated along the adjacent surface. The continuous portion may have a length that is substantially greater than a width of the continuous portion. The continuous portion may be less than entire area of the adjacent surface. A continuous portion may include less than twenty percent, less than ten percent, or less than five percent of a surface area of the adjacent surface. A continuous portion may not connect two edges of the adjacent surface. An end of the continuous portion may be positioned in a central region of the adjacent surface. A continuous portion may be provided in a radial direction on the adjacent surface from a center of the surface. In certain embodiments, a continuous portion may include a center location of the adjacent surface. For a barrier, an area of a surface the barrier that combusts in response to the ignition signal may be equal or greater than twice the size of an area of the continuous portion on the adjacent surface.

In embodiments, a conductor may be integrated into the barrier or the primer material. The conductor may be integrated into a contact surface of the primer material, not adjacent to a wall or base of a primer cup in which the primer material is disposed. In FIG. 4, conductor 440 may be physically integrated into primer material 470 or barrier 480. Integration may be implemented in different manners For example, during assembly the conductor may be physically pressed into the barrier or primer material. A physical force may be applied to the primer cup, securing it into the ignition cap. Such a force may alternately or additionally secure the electrical conductor between the barrier or primer material and a solid surface of the isolator or other component, such as a surface of an ignition cap. The force may be applied to the primer cup or, alternately, a component opposite the primer cup relative to an intermediate location of the conductor. For example, the force may be applied to an external end of the ignition cap during assembly. This force may apply physical pressure to intermediate components between an ignition cap and a primer cup. This force may cause a depression to form in a surface of the barrier or primer material to which the conductor is adjacent. The conductor may be retained in the formed depression. A range of motion available to the retained conductor may become less than prior to the integration, imposed by an indented surface of the depression in which the conductor is located. The physical force may be less than or equal to 100 pounds per square inch, less than or equal to 200 pounds per square inch, less than or equal to 300 pounds per square inch, less than or equal to 400 pounds per square inch, less than or equal to 500 pounds per square inch, or greater than 500 pounds per square inch.

Alternately or additionally, the conductor may be integrated into the barrier using an integration signal. An integration signal is an electrical signal transmitted through the conductor. The integration signal may be applied after the primer material has been disposed adjacent the conductor. The integration signal may also be applied after the barrier has been disposed proximate the conductor, between the conductor and the primer material. The integration signal may be applied prior to the propulsion module being coupled with any housing for potential deployment of a projectile of the propulsion module. The integration signal may be provided by a signal source. The signal source may be separate from a signal generator incorporated in a housing, such as an example as shown in FIG. 1. Alternately, in certain embodiments, a signal generator in a housing may also serve as the source of the integration signal. The integration signal is applied to a propulsion module separately from and before any ignition signal. For a deployment unit for a CEW, an integration signal is applied to a propulsion module separately from and before any stimulus signal. The integration signal is applied to the conductor to increase a temperature of the conductor to a temperature greater than an ambient environmental temperature but lower than a temperature at which the primer material would ignite. For example, the integration signal may increase the temperature of the electrical conductor to at least 100 degrees Celsius. The integration signal may alternately or additionally increase a temperature of the electrical conductor to at least 80 degrees Celsius and/or nor greater than 150 degrees Celsius. Such an increased temperature may cause the barrier to at least partially melt (e.g., soften or at least temporarily decrease with respect to hardness of a surface of the barrier) during application of the integration signal to the electrical conductor. A change or temporary change in the barrier may allow, enable, or cause the conductor to be further physically coupled with the barrier. A change in the barrier caused by the application of the ignition signal may cause the electrical conductor to be at least partially secured, disposed, or integrated into the barrier, such that the electrical conductor may no longer be freely move or be removed from the barrier. An integration signal may be applied to the electrical conductor while an external force is applied between the electrical conductor and barrier. Example such forces may include those discussed above. An integration signal may alternately be applied to an electrical conductor prior to, after, or independently from any such external force. Integration of an electrical conductor into a barrier layer may decrease a spacing between an electrical conductor and a primer material, thereby increasing a rate and/or efficiency at which heat from an electrical conductor with an increased temperature from an ignition signal may be transferred to a primer material. Integration of a conductor into a primer material or barrier may decrease or preclude a range of motion available to the conductor along a surface of the primer material or barrier prior to integration. In FIG. 4, conductor 440 may be integrated into barrier 480. In FIG. 3, conductor 340 may be integrated into primer material 380.

A primer cup may be secured, retained, or otherwise disposed against an insulator and/or an ignition cap. A primer cup may enclose a primer material in a secure and partially protected manner. In FIG. 4, walls of primer cup 470 are provided between inner receptacle structure 415 of ignition cap 410 and a portion of insulator 430. Primer cup 470 may be press fit into this location between the inner receptacle structure 415 of ignition cap 410 and the portion of insulator 430. Primer material 460 is disposed, mounted, retained, or positioned within a concave region formed by walls and a base of the primer cup 470. A concave region of a primer cup 470 is open in a direction toward a first end of a propulsion module, opposite a direction in which a projectile or other object 490, such as a capsule, is provided for launch. This orientation simplifies compact assembly of primer material with a conductor for transfer of heat between the primer material and conductor. This orientation initially directs expanding gas from an ignited primer material in a direction away from a projectile. However, this orientation allows the primer cup to separate from a component to which it is secured, retained, or disposed prior to ignition of the primer material. Separation of the primer component may permit the motion of the primer cup to transfer, in part, a propulsion force from a rapidly expanding gas to a projectile or other object to be launched by the propulsion force. The expanding gas also provides ongoing propulsion force to or toward a projectile or other object, despite any orientation of a primer cup and/or initial direction imparted by a physical shape of an ignition device.

A propulsion force generated in response to ignition of a primer material may be applied inside a propulsion module to a gasket and/or projectile. A propulsion force may be based on pressure associated with an expanding gas or propellent. Motion of a component may transfer a propulsion force to another component in a propulsion module. In FIG. 4, motion of a primer cup 370 may transfer a propulsion force generated by ignition of primer material 460.

Motion of a gasket 420 may also transfer a propulsion force generated by ignition of primer material 460 to a projectile 490. A projectile 490 may comprise a capsule with a secondary source of propellant. Alternately, projectile 490 may be or comprise an electrode for a CEW. Ignition of primer material 460 provides a propulsion force that may be transferred to and/or by other components in a propulsion module. Gasket 420 may ensure that a propulsion force created by a primer material 460 is transferred in a controlled manner to a projectile 490 or other object. For example, gasket 420 may comprise a flexible material, resilient to provide a secure seal against an outer periphery of the gasket and an inner surface of housing 495. Propulsion module 400 may also include a puncture tip or other end structure at a distal location along housing 495 at a location opposite projectile 490 relative to a location of primer cup 470 within an inner chamber formed by housing 495.

To ignite the primer material 460 in FIG. 4, an ignition signal is received in a circuit formed in the ignition device of the propulsion module. Particularly, an ignition signal is conducted through an ignition pin 450 to a conductor 440 and ignition cap 410. The ignition signal, when conducted by the conductor 440, causes the conductor 440 to increase in temperature. The increase in temperature causes the conductor 440 to emit energy in the form of heat. The ignition signal increases the temperature of the conductor to at least an ignition temperature. An ignition temperature is below a breakdown temperature of the conductor at which the conductor physically degrades. Ignition temperature and breakdown temperatures may be defined relative to a common duration. For example, a breakdown temperature of a conductor for a given duration may cause the conductor to melt within the given duration, while the conductor will remain intact at an ignition temperature for this same duration. An ignition temperature of conductor does not cause the conductor to ignite, combust, or otherwise begin to physically degrade within a predetermined duration. Rather, an ignition temperature is a temperature of the conductor associated with transferring energy to a primer material to cause the primer material to ignite. A temperature of a conductor may increase without degrading the conductor within a given duration. A conductor with an increased temperature emit a red glow in the visible spectrum of light without degrading for at least a predetermined duration. If the conductor degrades, a signal may no longer be conducted through the conductor. A conductivity of the conductor may be disrupted or decreased upon degradation of the conductor.

An ignition temperature of the conductor is a temperature sufficient to radiate heat to a proximate primer material. Transferred heat may cause a temperature of a barrier to increase. An increase in the temperature of the barrier may cause it to combust. Transferred heat causes a temperature of the primer material to increase. The heat may be transferred through the barrier from the conductor. An increase in the temperature of the primer material may cause it to ignite. An autoignition temperature of a primer material is a temperature at which the primer material itself ignites, initiating combustion of the primer material and rapid expansion of gas from the primer material as it combusts. An ignition temperature of a conductor may be greater than an autoignition temperature of a primer material. Such a difference in temperature may ensure that sufficient heat is transferred from the conductor to the primer material to cause the primer material to rapidly ignite upon conduction of the ignition signal through the conductor.

In embodiments according to various aspects of the present disclosure, ignition of the primer material is caused by the ignition signal. As discussed elsewhere herein, the ignition signal is conducted through the conductor along a surface of the primer material. The conductor conducts the ignition signal outside the primer material. The ignition signal is not conducted through the primer material. The ignition signal does not arc through the primer material. The ignition signal does not provide a spark to the primer material. The ignition signal increases a temperature of the conductor which, in turn, increases a temperature of the primer material to a temperature sufficient to cause the primer material to ignite. The primer material ignites in response to a source of increased temperature outside the primer material. The ignition temperature may cause a temperature on a surface of the primer material to reach an autoignition temperature. An entire body of primer material may not reach the autoignition temperature prior to ignition of the primer material; rather, a surface and side of the primer material may reach the autoignition temperature prior to ignition, separate from and independent of whether other portions of the primer material reach such a temperature before ignition. An ignition temperature of the conductor may be at least 200 degrees Celsius, at least 300 degrees Celsius, or equal or greater than 450 degrees Celsius. A temperature of the conductor may be increased by at least 150 degrees Celsius, at least 250 degrees Celsius, at least 350 degrees Celsius.

By conducting an ignition signal along a path that is external to the primer material, such an arrangement increases a reliability of ignition of the primer material upon application of a predetermined amount of energy. Such an arrangement eliminates a variability that may be otherwise present in alternate solutions. For example, example embodiments according to various aspects of the present disclosure avoid uncertainty in the electrical path formed when an electrical signal is applied directly to a primer material. Such embodiments also avoid a need to transfer an electrical signal across a boundary of an electrical connector and a boundary of the primer material itself. By conducting an ignition signal adjacent a surface of a primer material instead of through the primer material, it become unnecessary to provide conductive elements and a conductive signal path on multiple sides of a primer material and/or primer cup. In the example of FIG. 4, conductive elements are not required along a second side of primer material 460 or primer cup 470, aside from a first side and surface along which a conductor 440 is provided. In embodiments according to various aspects of the present disclosure, conductive components or portions of conductive components may be provided on one or more second sides of the primer material 460 or primer cup 470 for additional transfer of heat, but such optional modifications may still be optional and are not required, particularly for transfer of an electrical signal through the primer material 460 or primer cup 470. As shown in FIG. 4, a conductor and signal path for an ignition signal may be provided adjacent only one side of primer material, yet still be configured to cause the primer material to ignite.

In the example of FIG. 4, a change in temperature of the ignition pin 450 may be lower than conductor 440 and/or negligible in comparison to the increase in temperature of conductor 440. The ignition pin 450 may also be aligned with a shallow, recessed region in a center of the primer material 460 in the primer cup 470, thereby decreasing an effectiveness, reliability and thus value of a temperature increase in the ignition pin 450, if any.

While certain spacing or gaps are shown in the schematic illustration of FIG. 4, example embodiments according to various aspects of the present disclosure may include no such gaps or spacing between two given components. For example, no space may exist between conductor 440 and barrier 480 as described above. Similarly, one or more corresponding surfaces of isolator 430 may contact and/or be in immediate near proximity to other surfaces of components in the propulsion module, such as those of the ignition pin 450 or ignition cap 410. Embodiments according to various aspects of the present disclosure may include relative sizes between components that are illustrated in FIG. 4. For example, a width and length of an ignition pin 450 may each be less than a length and width of an insulator 430 within a same plane in a propulsion module. Relative dimensions may be included, excluded or optionally included in embodiments according to various aspects of the present disclosure.

Figure 5:
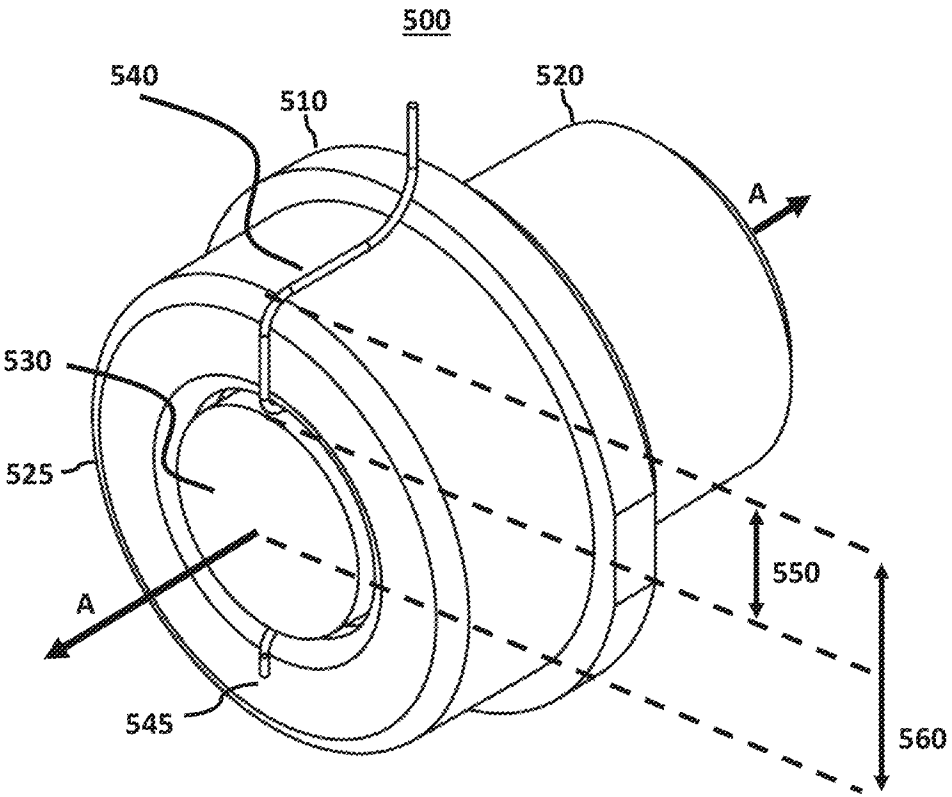
FIG. 5 is an illustration of an example embodiment of components of an ignition device according to various aspects of the present disclosure.

Upon assembly, components of an ignition device are closely coupled. Components may be closely coupled along a center axis of the ignition device, though other manners of assembly may be employed. An illustration of an example embodiment of assembled components of an ignition device according to various aspects of the present disclosure is shown in FIG. 5. Ignition device 500 includes an insulator 510, a first end 520 of the insulator, a second end of the insulator 525, an ignition pin 530, and a conductor 540. An insulator and ignition pin may be rigid component, not deformable upon application of a propulsion force, while a conductor may be a flexible component, able to be conformed to a shape of a surface of a component adjacent to which it is located. Ignition pin 530 is inserted within an inner bore of insulator 510. A center axis of each of ignition pin 530 and insulator 510 is aligned along axis A. As shown, a gap exists between the insulator 510 at a first end 525 and a corresponding end of the inserted ignition pin 530. At end 525 of the ignition device 500, a radius of an inner bore of the insulator 510 is greater than an outer radius of the ignition pin 530 relative to axis A. A difference in these radii is equal or greater than a diameter of conductor 540. Conductor 540 is coupled to ignition pin 530 at a recessed location at which ignition pin 530 is inserted within insulator 510. A conductor may encircle the ignition pin at a recessed location. Conductor 540, as illustrated, extends at least from a recessed location on ignition pin 530, along an end surface of end 525 and along a side surface of insulator 510. A shorter section 545 of conductor 540 is also illustrated, though this tail section 545 does not provide an electrical path for completing a circuit for a signal applied thereto. In embodiments according to various aspects of the present disclosure, no such tail section 545 is required or provided. A complete circuit exists in the ignition device independent of the inclusion of tail section 545. A circuit through components of an ignition device is provided by an ignition pin and a length of a conductor that extends beyond surfaces of an insulator. For example, a circuit though components of FIG. 5 is provided by ignition pin 530 and an upper, extended portion of a conductor 540. The upper, extended end of conductor 540 may be electrically coupled with an ignition cap and/or ground tab (not shown). Upon insertion into an inner bore of the insulator 510, a length of the ignition pin 530 may not extend beyond a second 520 of the insulator 510.

Upon further assembly, a primer cup may be provided over the first end 525 of the insulator 510. This further assembly places a portion of conductor 540 along an end surface of a first end of insulator 525 in physical contact or immediate proximity to a primer material disposed within the primer cup. Such an arrangement may also place a portion of conductor 540 along an end surface of a first end 525 of insulator 510 in contact with a barrier in the primer cup, if a barrier is provided within the primer cup. Upon assembly, a length of this portion of the conductor 540 may run parallel to an end surface of a first end 525 of insulator 510. Upon application of an ignition signal, a portion of conductor 540 along an end surface of a first end 525 of insulator 510 heats to at least an ignition temperature. A position of this portion of the conductor 540, supported by an end surface of a first end 525 of insulator 510, transfers heat from this portion of the conductor to the primer material, causing the primer material to ignite. A length 550 of a portion of conductor 540 along an end surface of a first end of insulator 525 is less than a radius 560 of the insulator 510 at a first end of insulator 525. For example, a length 550 of the conductor 540 along a radius from a center of an ignition pin 530 to an outer edge of an end surface of an end 525 of insulator 510 may be approximately half of length 560 of the radius. The center of ignition pin 530 which also aligns with a center of 510. A length 550 of the conductor along this radius may be less than seventy-five percent of length 560 of the radius or less than half of length 560 of the radius. A length 550 of the conductor along this radius may also or alternately be at least twenty-five percent of the length 560 of the radius. A maximum diameter of the end 525 of the insulator 510 may also defined along this radius, extending in a line from opposite edges of end 525 and passing through a center point of edge 525. Relative to the maximum diameter, a length 550 of the conductor 540 along this diameter may be less than half of the length of the diameter or less than quarter of the length of the diameter. Relative to a diameter of an end 525 of an insulator, as well as a contact surface of a primer material, a length 550 of the conductor may be less than 90 percent of the length of the diameter, less than 75 percent of the length the diameter, less than 50 percent of the length of the diameter, or less than 25 percent of the length of the diameter.

Upon assembly with a primer cup, a length 550 of the conductor would also be provided adjacent surface of a primer material from an edge of the primer material to a central region of the primer material. Upon assembly with a primer cup, a length 550 of the conductor may also be provided along a surface of a barrier from an edge of the barrier to a central region of the barrier if the barrier is included in the primer cup.

Collectively, a portion of a conductor 540 and ignition pin 530 may provide a conductive path from at least a center of a contact surface of a primer material to an outer region of the primer material, wherein the path is provided along and outside the contact surface, not through the surface. Such an arrangement may ensure that an ignition signal may be provided along a desired path, rather than other paths that may exist or may inadvertently be formed with other assemblies of components of an ignition device.

Figure 6:
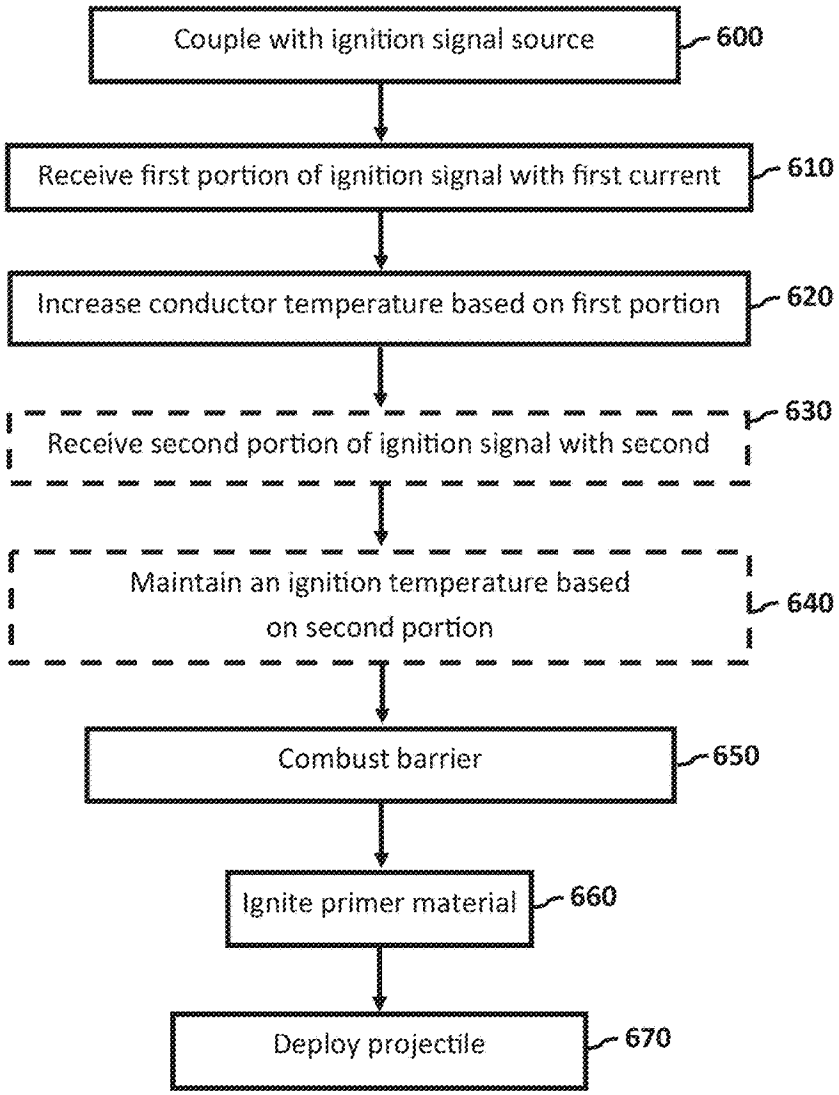
FIG. 6 is flowchart that illustrates an example embodiment of method of igniting a primer material to deploy a projectile according to various aspects of the present disclosure.

FIG. 6 is a flowchart that illustrates an example embodiment of a method of igniting a primer material to deploy a projectile according to various aspects of the present disclosure. At a high level, the method involves an ignition signal and an ignition device. The ignition device comprises a conductor and a primer material adjacent the conductor. The conductor may be positioned along a surface of the primer material. Alternately the conductor may be positioned adjacent the surface primer material, physically separated from primer material by a barrier. The conductor may not pass through the primer material or barrier such that a cross-section of the conductor, perpendicular along an elongated length of the conductor, is fully enclosed by the primer material. A width or thickness dimension of the conductor may not be surrounded, enclosed, encased by primer material. A surface of the conductor may be pressed into a surface of a primer material or barrier. A surface of the conductor may be disposed in a recessed channel formed on a surface of the primer material or barrier.

At step 600, the ignition device is coupled with an ignition signal source. For example, the ignition device may be placed in electrical contact with a signal generator on a separate device. The ignition device may also be provided with electrical communication with a control circuit on a separate device. In a CEW, a control circuit in a housing of the CEW may from an ignition signal source for an ignition device. The ignition device may be further coupled with an ignition signal source upon insertion of a deployment unit within a housing of a system for deploying a projectile using the ignition device. At step 600, a conductive signal path is created into a circuit, though an ignition signal is not yet received along the created signal path. As part of the coupling, the ignition device may complete a circuit with the ignition signal source. In a CEW, this step may involve inserting a cartridge with deployable electrodes in a portable housing of the CEW.

At step 610, a first portion of an ignition signal is received. An ignition signal may be generated by a signal generator. An ignition signal may be received by an ignition device from an ignition signal source. An ignition signal source may include a control circuit. An ignition signal source may be disposed in a separate device from an ignition device. An ignition signal source may be selectively and removably coupled with an ignition device in which a conductor is provided.

An ignition signal in example embodiments according to various aspects of the present disclosure includes at least a first portion. A first portion may have an associated duration, current, and voltage. Certain embodiments may also include a second portion. A second portion of the ignition signal may have a different duration, current, and/or voltage. An ignition signal may only have one portion in which a non-zero current and non-zero voltage are provided. Alternately, an ignition signal may have a first portion immediately followed by a second portion. A second portion may immediate follow a first portion in a non-overlapping and/or uninterrupted manner. A second portion may be longer than a first portion. A second portion may have a lower current than a first portion. A second portion may have a lower voltage than a first portion.

For example, a first portion may have a current value of at least 1 Amp, at least 2 Amps, at least 3 Amps, or equal or greater than 3.5 Amps. The first portion may have a duration of at least 30 milliseconds (ms), at least 40 ms, at least 50 ms, at least 60 ms, or equal or greater than 70 ms. The first portion alternately or additionally have a duration of less than 40 ms, less than 50 ms, less than 60 ms, less than 70 ms, or less than 80 ms. A first portion may have a voltage between 3 volts and 6 and volts. In a CEW, this voltage is particular noteworthy in comparison with a voltage of a stimulus signal, which may have a minimum voltage of at least 500 volts as noted above. These example values for an ignition signal further distinguish the ignition signal from a separate stimulus signal in a CEW.

Further, example embodiments of a second portion of an ignition signal according to various aspects of the present disclosure may have different durations, currents, and voltages compared to a first portion of the ignition signal. A current of a second portion may be lower than a first portion in order to increase a time over which a conductor may provide at least an ignition temperature before degrading. A duration of a second portion, if provided, may also be longer than a duration of a first portion, particularly when a second portion has a lower current. A higher first portion may decrease a time required for conductor to reach an ignition temperature, while a lower second portion increases a time at which the conductor may at least maintain this temperature before breaking down. For example, a second portion may have a current that is approximately seventy-five percent the magnitude of a current of a preceding first portion. A second portion may have a current value of at least 0.7 Amps, at least 1.4 Amps, at least 2.1 Amps, or equal or greater than 2.8 Amps. A duration of the second portion may be at least double the duration of a preceding first portion. A second portion may have a duration of at least 60 ms, at least 80 ms, at least 100 ms, at least 120 ms, or equal or greater than 140 ms. The second portion alternately or additionally have a duration of less than 80 ms, less than 100 ms, less than 120 ms, less than 140 ms, or less than 160 ms. A combined first and second portion may have an overall duration of less than 500 ms, less than 400 ms, less than 300 ms, less than 200 ms, or less than 100 ms. These durations may include durations during which an ignition signal provides a non-zero amount of current through the conductor. A second portion may have a voltage between 2 volts and 5 and volts. Again, such voltages for a second portion are less than comparative voltages for a stimulus signal in a CEW.

During a first or second portion, a current or voltage of the portion of the ignition signal may be constant. For example, an ignition signal may only have one portion during which a constant current of at least 1 Amp is provided. Constant values may be applied over the corresponding duration of the portion of the ignition signal. An ignition signal may not be provided or provide zero current or zero voltage outside a duration of a first portion or first portion and second portion. A primer material may be ignited during a first portion or a second portion, when provided, which may preclude a need for repeating an ignition signal for a given deployment unit. Each of the first portion and second portion may be generated from a control circuit based on one or more control signal. For example, a control signal may be provided to a signal generator to generate the first portion of the ignition signal, while a subsequent control signal may be provided to the signal generated to cause the signal generator to generate the subsequent second portion of the ignition signal.

At step 620, a temperature of a conductor increases in response to a received first portion of an ignition signal. A temperature of the conductor may increase to at least an ignition temperature during a duration of the first portion. A diameter, material, and other properties of a conductor may be selected to cause the conductor to heat to at least an ignition temperature upon receipt of a first portion of an ignition signal by the conductor. Alternately or additionally, a current and/or voltage of a first portion of an ignition signal may be selected depending on properties of a provided conductor. For example, a current of an ignition signal may be generated based on an amount of current necessary to increase a certain thickness of wire above an ignition temperature. A temperature of the conductor resulting from an applied ignition signal may substantially exceed an ignition temperature in order to promote a rapid increase in temperature of adjacent components in an ignition device. A temperature to which the conductor increases during a first duration or a first portion of an ignition signal may also be affected by an ambient temperature. Lower ambient temperatures may limit a temperature and increase in temperature achieved by a conductor during a first portion of an ignition signal. A conductor may receive the ignition signal for at least a duration of the first portion without degrading or otherwise breaking down. As the conductor increases in temperature, energy is radiated from the conductor in the form of heat. If provided, the heat radiates to a barrier. If provided, the heat radiates through the barrier. A temperature of the barrier increases in response to the heat and the increase in temperature of the conductor. When the temperature of the conductor increases, heat radiates to a primer material. A temperature of the primer material increases in response to the heat and the increase in temperature of the conductor.

At step 630, a second portion of an ignition signal may be received. This second portion is optional, as indicated by dashed lines in FIG. 6. As noted above, a second portion may have a different voltage, current, and/or duration in comparison with a first portion of an ignition signal.

At step 640, at least an ignition temperature of the conductor may be maintained in the conductor in response to the second portion of the conducted ignition signal if received. A second portion may maintain or adjust a temperature to which the conductor is increased during a first portion. A temperature attained during a first portion may exceed an ignition temperature for the conductor and the second portion may decrease a temperature of the conductor closer to the ignition temperature.

In other embodiments, a temperature of the conductor may be further increased at step 640. If an ignition temperature is not reached by the conductor during a first portion, conduction of a second portion may raise a temperature of the conductor to or above the ignition temperature. For example, a system such a CEW may be used in an environment with a low ambient temperature. A low ambient temperature may be below zero degrees Celsius. A low ambient temperature may prevent a first portion of an ignition signal from reaching an ignition temperature or reaching an ignition temperature for a predetermined duration. A second portion of an ignition signal may permit the conductor to reach at least an ignition temperature for a predetermined period of time and thereby radiate sufficient heat to increase a temperature of a primer material in close proximity with the conductor.

A first portion of an ignition signal may cause a conductor to reach an ignition temperature over a predetermined duration. Alternately, a first portion of an ignition signal may cause a conductor to increase in temperature, but an ignition temperature over a predetermined duration may be achieved during conduction of the second portion. Further still, a combination of an ignition temperature and a predetermined duration may be achieved during conduction of a combination of both a first portion and a second portion of an ignition signal via the conductor. A predetermined duration may be less than an entire duration of a first portion of an ignition signal, less than a duration of a second portion of an ignition signal, less than a duration of a combined first and second portion of an ignition signal.

In response to an increase in temperature of the conductor, a barrier, if provided, may combust as indicated at step 650. A barrier may only partially combust in response to an increase in temperature of the conductor. A barrier may begin to combust during a duration of a first portion or during a duration of a second portion of an ignition signal. A barrier may only combust in a region of the barrier near where a conductor is provided in direct physical contact. In embodiments, combustion of the barrier is not necessary for ignition of the barrier. An ignition device need not include a barrier, yet cause a primer material to ignite in response to application of an ignition signal in a conductor adjacent the primer material. A flame from a combusting barrier is not required to ignite a primer material. A primer material may ignite in response to an increase in temperature of a conductor, independent of whether a barrier is provided between the primer material and the conductor.

In response to an increase in temperature of the conductor, the primer material ignites at as indicated at step 650. Ignition of the primer material may occur during conduction of the first portion of the ignition signal through the conductor. Alternately, ignition of the primer material may occur during conduction of the first portion of the ignition signal through the conductor. The conductor does not melt or otherwise degrade before the primer material ignites. As discussed elsewhere herein, the primer material ignites in response to a temperature increase outside the primer material, rather than a temperature increase within the primer material itself. A primer material may combust when heat radiated from the conductor causes a temperature of the primer material to exceed an autoignition temperature of the primer material.

The ignition of the primer material based on temperature distinguishes example embodiments according to various aspects of the present disclosure from other potential manners of ignition, such as those that may involve an electrical signal being transmitted through the primer material itself. Other distinctions exist as well. For example, a voltage level of an ignition signal in some embodiments may be less than 10 volts, less than 6 volts and/or greater than 3 volts. In contrast, potential manners of ignition without an conductor adjacent the primer material may require greater voltages to transmit an electrical signal through the primer material itself. Such greater voltages may include greater than 800 volts, greater than 1000 volts, or greater than 2000 volts in order to transfer the ignition signal through the primer material itself. Example embodiments according to various aspects of the present disclosure require lower voltages than any such alternate approaches to igniting a primer material, thereby decreasing a load or demand placed upon an ignition signal source to produce an effective ignition signal. Example embodiments according to various aspects of the present disclosure may also decrease a demand on a battery, power supply, and or other intermediate circuit that would otherwise be required to provide any such higher voltages.

Ignition of the primer material generates a rapidly expanding gas. The expanding gas creates a propulsion force and the force is transferred directly or indirectly to a projectile. In response to application of the propulsion force from the ignited primer material and/or a secondary source of propellent activated by the ignited primer material, the projectile deploys 670 from the system. In a CEW, ignition of a primer material leads to deployment of electrodes from a deployment unit disposed in the CEW.

The foregoing description discusses embodiments, which may be changed or modified without departing from the scope of the invention as defined in the claims. For example, certain components or relationships between components may be excluded from some embodiments or optionally included in some embodiments. Examples listed in parentheses may be used in the alternative or in any practical combination. As used in the specification and claims, the words 'comprising', 'comprises', 'including', 'includes', 'having', and 'has' introduce an open-ended statement of component structures and/or functions. In the specification and claims, the words 'a' and 'an' are used as indefinite articles meaning 'one or more'. When a descriptive phrase includes a series of nouns and/or adjectives, each successive word is intended to modify the entire combination of words preceding it. For example, a black dog house is intended to mean a house for a black dog. While for the sake of clarity of description, several specific embodiments of the invention have been described, the scope of the invention is intended to be measured by the claims as set forth below. In the claims, the term "provided" is used to definitively identify an object that not a claimed element of the invention but an object that performs the function of a workpiece that cooperates with the claimed invention. For example, in the claim "an apparatus for aiming a provided barrel, the apparatus comprising: a housing, the barrel positioned in the housing", the barrel is not a claimed element of the apparatus, but an object that cooperates with the "housing" of the "apparatus" by being positioned in the "housing". The location indicators "herein", "hereunder", "above", "below", or other word that refer to a location, whether specific or general, in the specification shall be construed to refer to any location in the specification where the location is before or after the location indicator.

The invention includes any practical combination of the structures and methods disclosed. While for the sake of clarity of description several specifics embodiments of the invention have been described, the scope of the invention is intended to be measured by the claims as set forth below.

What is claimed is:

1. A conducted electrical weapon, comprising:

a housing comprising:

a bay defining a receptacle in the housing;

a trigger; and a control circuit configured to generate an ignition signal upon actuation of the trigger; and a deployment unit removably inserted into the bay, the deployment unit comprising:

an electrode configured to be deployed from the deployment unit; and a propulsion module comprising:

a conductor electrically coupled to the control circuit and configured to increase in temperature upon receipt of the ignition signal; and a primer material disposed adjacent the conductor within the propulsion module, wherein the primer material is configured to ignite in response to the increase in temperature of the conductor, and wherein the conductor conducts the ignition signal outside the primer material and ignition of the primer material causes the electrode to be deployed from the deployment unit.

2. The weapon of claim 1, further comprising a barrier disposed between the conductor and the primer material, wherein the barrier is configured to at least partially combust in response to the increase in temperature of the conductor.

3. The weapon of claim 2, wherein the barrier comprises paper.

4. The weapon of claim 2, wherein the conductor is integrated into the barrier.

5. The weapon of claim 1, wherein the conductor is disposed in contact with the primer material along a surface of the primer material.

6. The weapon of claim 1, wherein the conductor comprises a wire, wherein the wire is positioned adjacent a surface of the primer material, and wherein the wire is configured to provide a signal path for the ignition signal adjacent the surface of the primer material.

7. The weapon of claim 1, wherein the conductor comprises a nichrome wire.

8. The weapon of claim 1, wherein the conductor is positioned adjacent a surface of the primer material, and wherein a length of the conductor adjacent the surface of the primer material is less than a diameter of the surface of the primer material.

9. The weapon of claim 1, wherein the conductor is positioned adjacent a first surface of the primer material from an edge of the first surface of the primer material to a central region of the first surface of the primer material.

10. The weapon of claim 1, wherein the ignition signal has a current of at least 2 Amps.

11. The weapon of claim 1, wherein a duration of the ignition signal is less than 300 milliseconds.

12. The weapon of claim 1, wherein the ignition signal comprises a first portion and a second portion, wherein the first portion and the second portion each provide a different current to the conductor, and wherein at least one of the first portion and the second portion causes ignition of the primer material.

13. The weapon of claim 1, wherein the propulsion module further comprises a primer cup, wherein the primer cup comprises walls and a base, and wherein the primer material is positioned within the primer cup between the base of the primer cup and the conductor.

14. A propulsion device for deploying at least one provided projectile using an ignition signal from a provided ignition signal source, the propulsion device comprising:

a conductor, configured to receive the ignition signal from the provided ignition signal source and increase in temperature upon receipt of the ignition signal;

a primer material disposed adjacent the conductor within the propulsion device, the primer material configured to ignite in response to the increase in temperature of the conductor, wherein the conductor conducts the ignition signal outside the primer material and ignition of the primer material causes the at least one provided projectile to be deployed; and a primer cup comprising a base axially offset from the conductor, wherein the primer material is positioned within the primer cup between the base of the primer cup and the conductor.

15. The propulsion device of claim 14, further comprising a barrier disposed between the conductor and the primer material, wherein the barrier is configured to at least partially combust in response to the increase in temperature of the conductor.

16. The propulsion device of claim 14, wherein the conductor comprises a nichrome wire positioned adjacent a surface of the primer material, and wherein the conductor is configured to provide a signal path for the ignition signal adjacent the surface of the primer material.

17. The propulsion device of claim 14, wherein ignition of the primer material produces a rapid expansion of gas, and wherein the rapid expansion of gas separates the primer cup from the propulsion device.

18. A method of deploying at least one projectile using a propulsion device, the propulsion device including a conductor adjacent a primer material, the method comprising:

receiving an ignition signal in the conductor, wherein the ignition signal is conducted by the conductor outside the primer material and adjacent a surface of the primer material;

increasing a temperature of the conductor based on the received ignition signal;

igniting the primer material in response to the increase in the temperature of the conductor, wherein ignition of the primer material causes the at least one projectile to be deployed; and providing a stimulus signal through the at least one projectile.

19. The method of claim 18, further comprising at least partially combusting a barrier between the conductor and the primer material in the propulsion module, wherein the primer material ignites after the at least partially combusting the barrier.

20. The method of claim 18, wherein the primer material has an associated temperature at which the primer material ignites in response to the increase in temperature of the conductor, and wherein increasing the temperature of the conductor based on the received ignition signal includes increasing the temperature of the conductor above the associated temperature at which the primer material ignites.

* * * * *